United States Patent [19]

Narisawa et al.

[11] Patent Number: 4,910,673

[45] Date of Patent: Mar. 20, 1990

[54] APPARATUS FOR CONTROLLING ARM MOVEMENT OF INDUSTRIAL VEHICLE

[75] Inventors: Junichi Narisawa, Tokyo; Kenichiro Date, Ibaragi; Kenichi Miyata, Ibaragi; Yuhei Sato, Ibaragi, all of Japan

[73] Assignee: Hitachi Construction Machinery Co., Ltd., Tokyo, Japan

[21] Appl. No.: 199,190

[22] Filed: May 26, 1988

[30] Foreign Application Priority Data

May 29, 1987 [JP] Japan ..... 62-135413
Mar. 23, 1988 [JP] Japan ..... 63-70404

[51] Int. Cl.[4] ..... G06F 15/20; E02F 3/46

[52] U.S. Cl. ..... 364/424.07; 37/DIG. 1; 37/116; 172/2; 364/167.01

[58] Field of Search ..... 364/513, 167.01, 424.01, 364/424.05, 424.07, 174; 173/2, 4, 39, 43; 37/DIG. 1, 116; 901/1; 175/24; 172/2-12

[56] References Cited

U.S. PATENT DOCUMENTS

| | | | |
|---|---|---|---|
| 3,934,126 | 1/1976 | Zalesov et al. | 364/424.07 |
| 4,035,621 | 7/1977 | Kemp | 364/424.07 X |
| 4,630,685 | 12/1986 | Huck, Jr. et al. | 364/424.07 X |
| 4,677,555 | 6/1987 | Goyet | 364/424.07 |
| 4,791,549 | 12/1988 | Heiser et al. | 364/167.01 |

*Primary Examiner*—Joseph Ruggiero
*Attorney, Agent, or Firm*—Cushman, Darby & Cushman

[57] ABSTRACT

In an industrial vehicle having at least first and second arms rotatably coupled to each other, a locus depicted by a tip of the second arm during rotation of the first and second arms is controlled. An amount of positional deviation of the tip of the second arm in the direction (compensating direction) perpendicular to the direction of the targeted locus (operating direction) is detected. A command value for the compensating velocity is determined from a command value for the operating velocity and the deviation. The driving of the first and second arms is controlled by the two velocity command values in the operating and compensating directions in such a manner that the tip of the second arm moves along the targeted locus. In short, positional feedback is provided by means of the positional deviation in the direction perpendicular to the targeted locus. In addition, the direction of the targeted locus is set as the direction of installation of an operating attachment mounted on the tip of the second arm. In an industrial vehicle further having a third arm, the second and third arms are driven in such a manner that the tip of the third arm will not deviate from the targeted locus as a result of the rotation of the first arm. At this juncture, the aforementioned feedback is also provided.

·22 Claims, 26 Drawing Sheets

Fig. 22

| CONTROLLING DIRECTION | ARC CONTROL RANGE OF No. 1 ARM | | | OPERATING HEIGHT CONTROL RANGE | | | SELECTION OF CONTROL | |
|---|---|---|---|---|---|---|---|---|
| | $A_{1MAX}$ OR MORE | INTERMEDIATE | LESS THAN $T_{1MIN}$ | $H_{Y1}$ OR MORE | INTERMEDIATE | LESS THAN $H_{Y2}$ | 1ST METHOD | 2ND METHOD |
| | | | ○ | | | ○ | ○ | |
| | | ○ | | | | ○ | ○ | |
| | | | ○ | | ○ | | | ○ |
| $\dot{Y}>0$ | | ○ | | | ○ | | | ○ |
| | | ○ | | ○ | | | | ○ |
| | ○ | | | | ○ | | ○ | |
| | ○ | | | ○ | | | ○ | |
| | ○ | | | ○ | | | ○ | |
| | | ○ | | ○ | | | ○ | |
| | ○ | | | | ○ | | | ○ |
| $\dot{Y}<0$ | | ○ | | | ○ | | | ○ |
| | | ○ | | | | ○ | | ○ |
| | | | ○ | | ○ | | ○ | |
| | | | ○ | | | ○ | ○ | |

100
101
102
103
104
105
106
107
108
109
110
111
112
min
min
a
b
X
Hy
A1
T1
X0
Y
Y1
Y2
A1MAX
T1MIN
T1MIN
Hy1
Hy2
X0
X0
Hy1
Hy2
Hy
Hy
1
0
1
0
1
0

APPARATUS FOR CONTROLLING ARM MOVEMENT OF INDUSTRIAL VEHICLE

BACKGROUND OF THE INVENTION

1. Field of the Invention:

The present invention relates to an apparatus for controlling arm movement of an industrial vehicle having at least two arms the movement of which is controlled.

2. Description of the Prior Art:

The present applicant has earlier proposed an industrial vehicle for foundation work (hereafter referred to as an industrial vehicle) as shown in FIGS. 9A and 9B. The industrial vehicle has a No. 1 arm 1, a No. 2 arm 2, and a No. 3 arm 3 articulated with each other as well as a first cylinder 4, a second cylinder 5, and a third cylinder 6 for driving these arms. An operating attachment such as a vibro-hammer 7, an auger drill unit 8, or the like is installed at a tip of the No. 3 arm 3. In FIGS. 9A and 9B, reference character PL denotes a sheet pile, and DR denotes an auger drill.

When such an industrial vehicle is used to drive in a sheet pile PL using the vibro-hammer 7 or bore a hole by rotating the auger drill DR by means of the auger drill unit 8, there are cases where the sheet pile PL becomes broken and the drill DR becomes damaged unless the tip of the No. 3 arm 3 is operated vertically with respect to the ground. For this reason, an assistant must be stationed in the vicinity of the industrial vehicle to visually confirm the horizontal deflection of the tip of the No. 3 arm 3 and signals the operating direction of the arm to the operator, so as to ensure, for instance, that the sheet pile PL is driven in as vertically as possible with respect to the ground.

An apparatus for controlling a position of a tip of an arm (hereafter referred to as an arm movement controlling apparatus) is conventionally known which is applied to a hydraulic power shovel having a shovel body, a boom, an arm, and a bucket installed at a tip of the arm and which is capable of controlling the position of the rotating point of the bucket in a desired direction. For instance, in the arm movement controlling apparatus known through Japanese Patent Publication No. 45025/1986, in order to control the position of the rotating point of the bucket, the targeted rotating speeds of the boom and the arm are respectively calculated by using signals from levers for controlling the speeds in the horizontal and vertical directions at the rotating point of the bucket. The flow rates of cylinders for driving the boom and the arm are controlled by using the signals thus calculated, thereby moving the rotating point of the bucket along a targeted locus (a targeted path).

However, when the movement of the tip of the No. 3 arm 3 is controlled by a manual operation in the former industrial vehicle which is not provided with the above-described arm movement controlling apparatus, the following problems are encountered:

(1) Since the horizontal deflection of the tip of the No. 3 arm 3 is confirmed visually, it is difficult to obtain desired positional accuracy with respect to the targeted locus.

(2) The operator must operate three operating levers for controlling the respective cylinders in accordance with the instructions of the assistant, so that the operating efficiency declines.

If the arm movement controlling apparatus disclosed in Japanese Patent Publication No. 45025/1986 is applied simply as it is to the above-described industrial vehicle in order that the tip of the No. 3 arm of the industrial vehicle moves along the targeted locus, the following problems are encountered:

(1) In the case of the arm movement controlling apparatus of the above publication, when the arm is controlled to move in the vertical direction, targeted angular velocities of the boom and the arm are calculated from the set value of the vertical velocity given by the lever and the value of the horizontal velocity being set to zero. However, since the positional feedback related to the position of the tip of the arm is not given, even if an error arises in the horizontal direction of the tip of the arm, it is impossible to compensate for the same. In particular, when the arm movement is controlled by driving cylinders using pressure oil whose flow rate is regulated by a solenoid proportioning valve as in the case of a hydraulic industrial vehicle, there are variations in the flow-rate characteristics of the solenoid proportioning valve itself in a low-flow-rate region, so that the arm movement controlling apparatus cannot be simply applied to an operation for which highly accurate vertical movement is required as in the case of the aforementioned operation of driving in of the sheet pile.

(2) In the above-described publication, feedback of the angular velocities are provided in a flow-rate controlling system in order to reduce such horizontal errors. However, since the velocities of movement of the rotating point of the bucket along the targeted locus in an execution operation such as the driving in of the sheet pile are slow, the angular velocities, e.g., values of differential of the arm and boom angle detected by angle detectors become very small, so that the feedback of the angular velocity does not lead to an accuracy of the position of the rotating point of the bucket to high degree.

In the arm movement controlling apparatus described in the above-described publication, the control of the vertical movement (horizontal veclocity=0) is effected by operating a boom lever alone, the control of the horizontal movement (vertical velocity=0) is effected by operating an arm lever alone, and the control of the diagonal movement is effected by operating the boom and arm levers simultaneously. With respect to this control of the diagonal movement, the control of movement in the direction of 45 degrees would be possible if the two levers are operated at the same velocity. However, the control of movement in a desired direction is difficult since the two levers must be constantly operated at a specified ratio of velocity. To overcome the difficulty of this operation, it is conceivable to provide an arm movement controlling apparatus in which a constant K is input arbitrarily by a device for setting the direction of the target locus along which the tip of the arm is controlled to be moved, and in which not only the vertical velocity but also the horizontal velocity given by a (K×vertical velocity) are imparted by operating the boom lever alone. However, in an operation in which, for instance, the sheet pile is driven into the ground by means of the vibro-hammer suspended from the tip of the arm, unless the starting direction of driving in the sheet pile coincides with the direction of the targeted locus predetermined by the input of the aforementioned constant K, undue forces are applied during driving in, possibly resulting in the breakage of the sheet pile.

Furthermore, when a locus control in which the tip of the arm is moved along the targeted locus is performed in an industrial vehicle having, for instance, three arms articulated with each other, if the three arms are driven simultaneously, it is impossible to perform the locus control. Therefore, the locus control has conventionally been performed under the condition of restricting movement of any one of the arms. For this reason, in cases where the amount of movement of the tip of the arm is large during the locus control as in the case of the driving in of an elongated sheet pile (i.e., in a case where the operating range is wide), it is necessary to suspend the operation temporarily midway in the operation and then to resume it after altering the posture of the arm of which movement has been restricted, thereby to perform the locus control over the entire operating range. As a result, there has been the drawback of deteriorated operating efficiency.

SUMMARY OF THE INVENTION

Accordingly, it is a primary object of the present invention to provide an apparatus for controlling the arm movement of an industrial vehicle which is capable of improving the accuracy of a locus by feeding back an error of a tip of an arm in a position perpendicular to the direction of the targeted locus.

Another object of the present invention is to provide an apparatus for controlling the arm movement of an industrial vehicle in which the direction of a targeted locus is set in accordance with the posture of an operating attachment in order that breakage of a sheet pile, an auger drill, or the like can be prevented.

Still another object of the present invention is to provide an apparatus for controlling the arm movement of an industrial vehicle which effects a locus control by driving three arms simultaneously, thereby enhancing the operational efficiency.

To these ends, according to one aspect of the present invention, there is provided an apparatus for controlling the arm movement of an industrial vehicle, wherein an amount of deviation of a position of a tip of a second arm in a direction (a compensating direction) perpendicular to a direction of a targeted locus (an operating direction) from the target locus is detected, a command value for the velocity in the compensating direction is determined from a command value for the velocity in the operating direction, and a first arm rotatively connected to the second arm and the second arm are driven by using the command values for the velocities in the two directions and the deviation set forth above in such a manner that the tip of the second arm moves along the targeted locus.

Accordingly, both the positional accuracy and the operating efficiency are improved as compared with a conventional apparatus. In particular, even in the case of an operation in which an operating speed is slow such as an operation using a vibro-hammer or an earth auger, it is possible to obtain desired positional accuracy without being affected by variations in the flow-rate characteristics of flow-rate control valves or the like.

In addition, according to another aspect of the present invention, there is provided an an apparatus for controlling the arm movement of an industrial vehicle, wherein the direction of the targeted locus is set in accordance with the direction of installation of an operating attachment, i.e., the posture of the operating attachment, at the start of an operation or during an operation. Consequently, no undue force is applied to a sheet pile, an auger drill, or the like, thereby making it possible to prevent the breakage thereof. At the same time, since there is no need to input the operating direction, i.e., the direction of the targeted locus per se, the operating efficiency can be improved.

Furthermore, according to still another aspect of the present invention, the angular velocity of the first arm is controlled, the angular velocities of the second and third arms are controlled in such a manner as to offset a deviation of the position of the tip of the third arm caused by the rotation of the first arm from the targeted locus. In addition to the controls of the second and third arms mentioned above, deviation of the position of the tip of the third arm from the targeted locus is constantly detected, and this deviation is fed back for the control of the angular velocity of the second and third arms. Accordingly, even in the case of an operation involving a wide operating range, such as an excavating operation by a clamshell, it is possible to perform the locus control continuously by driving the three arms by means of a single control lever or the like.

These and other objects, features and advantages of the present invention will become more apparent from the following description of the invention when read in conjunction with the accompanying drawings.

BRIEF DESCRIPTION OF THE DRAWINGS

Figs. 1 to 11 illustrate a first embodiment of the present invention, in which FIG. 1 is a diagram defining a coordinate system;

FIG. 2 is a block diagram of an overall configuration of an arm movement controlling apparatus;

FIG. 3 is a block diagram of a circuit for calculating a command value for the compensating velocity;

FIG. 5 is a block diagram of a circuit for calculating an angular velocity control value;

FIG. 6 is a block diagram of a circuit for calculating a flow-rate control value;

FIG. 7 is a diagram illustrating compensation of a link;

FIG. 8 is a diagram illustrating an operating range of an industrial vehicle;

FIGS. 10 and 11 are diagrams illustrating a modification of the first embodiment with a No. 4 arm added thereto, in which FIG. 10 is a diagram illustrating the No. 4 arm;

FIG. 11 is a diagram defining coordinates thereof and the like;

FIGS. 12 to 18 illustrate second and third embodiments of the present invention, in which FIG. 12 is a side-elevational view of an industrial vehicle in accordance with the third embodiment;

FIG. 13 is a diagram defining a coordinate system;

FIG. 14 is a block diagram illustrating an overall configuration of the arm movement controlling apparatus in accordance with the second embodiment;

FIG. 15 is a detailed diagram of an operating direction calculating circuit in accordance with the second embodiment;

FIG. 16 is a block diagram illustrating an overall configuration of the arm movement controlling apparatus in accordance with the third embodiment;

FIG. 17 is a detailed diagram of the operating direction calculating circuit in accordance with the third embodiment;

FIG. 18 is a detailed diagram of the circuit for calculating a flow-rate control value in accordance with the third embodiment;

FIGS. 19 to 30 illustrate a fourth embodiment, in which

FIG. 19 is a diagram defining a coordinate system;

FIG. 20 is a diagram illustrating the velocity of a tip of a No. 3 arm as a result of the rotation of a No. 1 arm;

FIG. 21 is a diagram illustrating regions classified by the angles of the No. 1 arm and the height of the tip of the No. 3 arm;

FIG. 22 is a table illustrating the selection of a control system in correspondence with operating conditions;

FIG. 24 is a block diagram of an overall configuration of the arm movement controlling apparatus in accordance with the fourth embodiment;

FIG. 25 is a block diagram of a first circuit for calculating a command value for the compensating velocity;

FIG. 26 is a block diagram of an arithmetic circuit for dividing a command value for the operating velocity into two components;

FIG. 27 is a block diagram of a second circuit for calculating a command value for the compensating velocity;

FIG. 28 is a block diagram of a second circuit for calculating an angular velocity control value;

FIG. 29 is a block diagram of a first circuit for calculating an angular velocity control value;

FIG. 30 is a block diagram of a circuit for calculating a flow-rate control value;

FIGS. 31 and 32 illustrate a fifth embodiment of the present invention, in which FIG. 31 is a block diagram illustrating an overall configuration of the arm movement controlling apparatus;

FIG. 32 is a block diagram of a first circuit for calculating an angular velocity control value.

DESCRIPTION OF THE PREFERRED EMBODIMENTS

[First Embodiment]

Referring now to FIGS. 1 to 11, a first embodiment of the present invention will be described. Hereafter, a description will be given of a case in which the present invention is applied to an industrial vehicle shown in FIG. 9A.

Figures 9A, 9B:
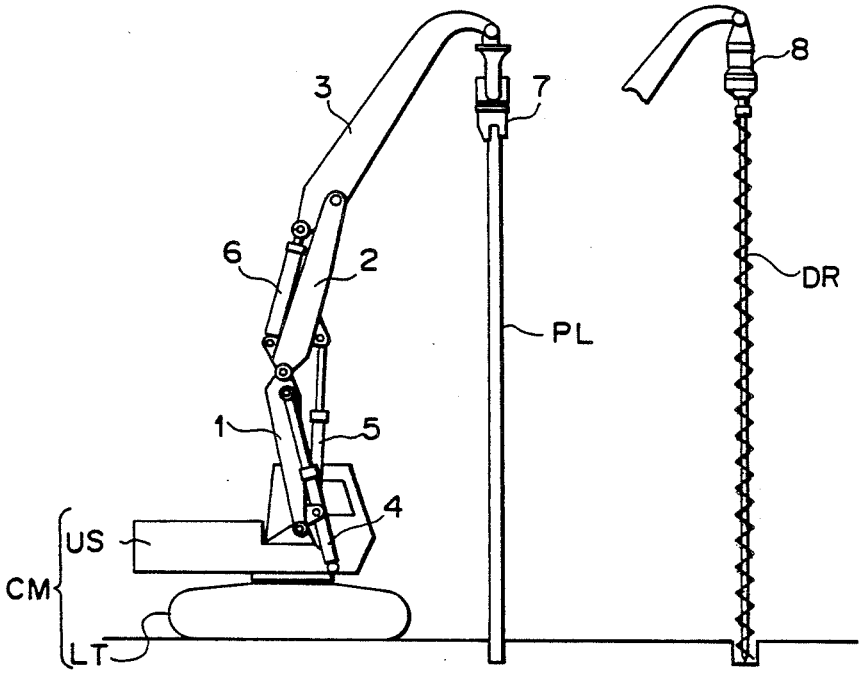
FIG. 9A is a side-elevational view of the industrial vehicle with a vibro-hammer mounted thereon.
FIG. 9B is a side-elevational view of an earth auger.

In FIG. 9A, a revolving super structure US is provided on a base carrier LT, thereby constituting an industrial vehicle body CM. A No. 1 arm 1 is revolvably provided on the revolving super structure US, a No. 2 arm 2 is provided revolvably at a tip of the No. 1 arm 1, and a No. 3 arm is provided revolvably at a tip of the No. 2 arm 2. The arms 1 to 3 are respectively driven by hydraulic cylinders 4 to 6. An operating attachment, e.g., a vibro-hammer unit 7, is coupled to a tip of the No. 3 arm 3 by means of a pin. Similarly, it is possible to use an earth auger drill unit 8, as shown in FIG. 9B. It should be noted that a first arm as stated in claims 1 to 10 appended hereto corresponds to the No. 2 arm referred to in this embodiment, while a second arm as stated therein corresponds to the No. 3 arm referred to in this embodiment.

Figure 1:
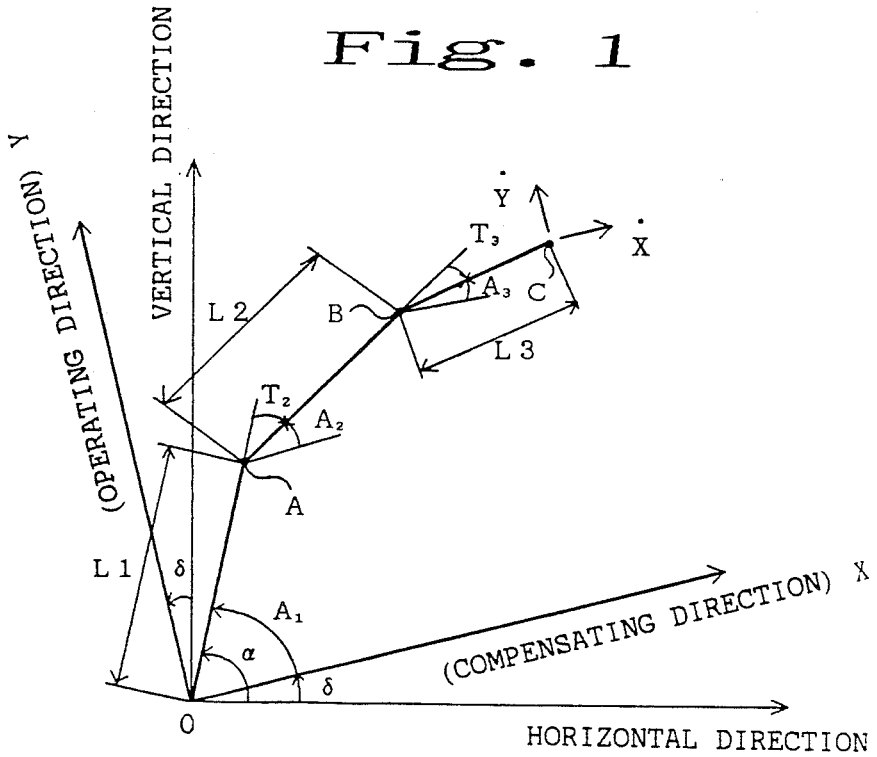

FIG. 1 shows a coordinate system of an industrial vehicle which is used in the first embodiment, and the following description will be based on this coordinate system. In FIG. 1, Origin O: point of supporting the rotation of the No. 1 arm 1

Point A: point of supporting the rotation of the No. 2 arm 2

Point B: point of supporting the rotation of the No. 3 arm 3

Point C: connecting point of the operating attachment at the tip of the No. 3 arm 3

X-axis: straight line which lies in a plane including the points O, A, B, and C and forms an angle $\delta$ with respect to an intersecting horizontal line passing through the point O (a direction of this straight line will be referred to as the compensating direction)

Y-axis: straight line which lies in a plane including the points O, A, B, and C, passes through the point O, and is perpendicular to the X-axis (a direction of this straight line will be referred to as the operating direction)

$L_1$: length between the points O and A $L_2$: length between the points A and B $L_3$: length between the points B and C $\alpha$: angle formed by a segment OA with respect to the ground $A_1$: angle formed by a segment OA with respect to the X-axis $A_2$: angle formed by a segment AB with respect to the X-axis $A_3$: angle formed by a segment BC with respect to the X-axis $T_2$: angle formed by an extension of the segment OA and the segment AB $T_3$: angle formed by an extension of the segment AB and the segment BC $\delta$: angle formed by the X-axis perpendicular to the Y-axis with respect to the horizontal direction and defining a direction of a targeted locus where $$A_1=\alpha-\delta$$

$$A_2=A_1-T_2$$

$$\begin{aligned} A_3 &= A_2 - T_3 \\ &= A_1 - T_2 - T_3 \end{aligned}$$

(1) Configuration of the Overall Apparatus

Figure 2:
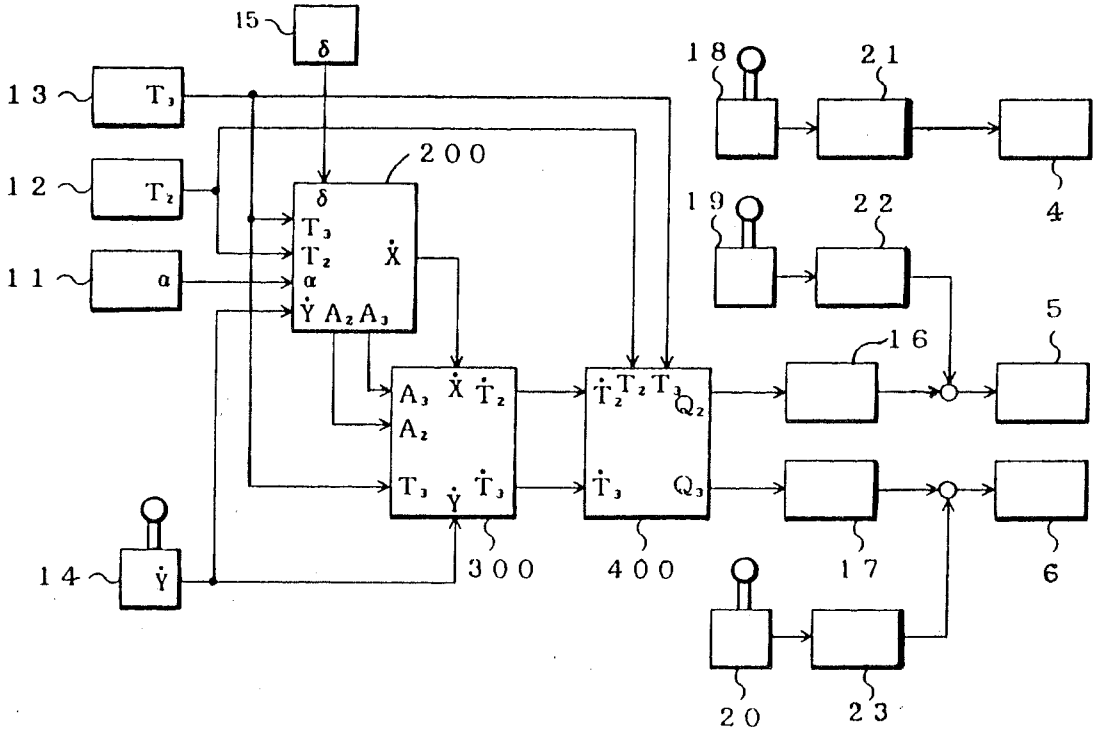

FIG. 2 is a schematic diagram of the overall controlling apparatus.

An angle detector 11 is provided in the vicinity of a point of supporting the rotation of the No. 1 arm 1. The angle detector 11 is adapted to detect the angle $\alpha$ of the No. 1 arm 1 with respect to the ground by means of known pendulum mechanism and potentiometer, and inputs the detected angle $\alpha$ to a circuit 200 for calculating a command value for the compensating velocity. Angle detectors 12 and 13 are respectively installed at points of supporting the rotation of the No. 2 and No. 3 arms 2, 3. The angle detectors 12 and 13 are adapted to detect the relative angle $T_2$ between the No. 1 and the No. 2 arms 1, 2 and the relative angle $T_3$ between the No. 2 and No. 3 arms 2, 3, respectively, by means of known lever mechanisms and potentiometers, and input the relative angles $T_2$, $T_3$ to the circuit 200 for calculating a command value for the compensating velocity and a circuit 400 for calculating a flow-rate control value. A control lever 14 installed in the operator's cabin is constituted by, for example, a known lever mechanism and potentiometer, and outputs a signal corresponding to the operating angle of the lever. This signal is input to the circuit 200 for calculating a command value for the compensating velocity and a circuit 300 for calculating an angular velocity control value as a command value $\dot{Y}$ for the operating-direction velocity (a command value for the operating velocity) of the tip of the No. 3 arm 3. An operating direction setter 15 is used to set the direction of the targeted locus along which the tip of the No. 3 arm 3. The angle $\delta$ formed by the horizontal direction and the direction perpendicular to the operating direction of the tip of the No. 3 arm 3, which represents the direction of the targeted locus, is set by the operating direction setter 15 and inputted to the circuit 200 for calculating a command value for the compensating velocity. For instance, when a sheet pile is driven in vertically with respect to the horizontal plane, the value $\delta$ is set such as to equal 0 (degree), while, when the tip of the No. 3 arm 3 is moved horizontally, it is set such as to equal 90 (degrees). In other words, the direction which forms the angle $\delta$ with the vertical direction is the direction of the targeted locus. Incidentally, the value $\delta$ can be desirably set to an arbitrary one by a manual operation.

On the basis of the angles $\alpha$, $T_2$, $T_3$, the value $\delta$ for setting the operating direction, and the operating direction command value $\dot{Y}$, the circuit 200 for calculating a command value for the compensating velocity calculates a command value $\dot{X}$ for the velocity in the compensating direction (i.e., a command value for the compensating velocity) as well as the angles $A_2$, $A_3$ formed by the No. 2 and No. 3 arms 2, 3 with respect to the X-axis, and inputs them to the circuit 300 for calculating an angular velocity control value. On the basis of the angles $A_2$, $A_3$, $T_3$ and the velocity command values $\dot{X}$, $\dot{Y}$, the circuit 300 for calculating the angular velocity control value calculates angular velocity control values $\dot{T}_2$, $\dot{T}_3$ of the No. 2 and No. 3 arms 2, 3 and inputs them to the circuit 400 for calculating the flow-rate control value. On the basis of the angular velocity control values $T_2$, $T_3$ thus calculated and the angles $\dot{T}_2$, $\dot{T}_3$, the circuit 400 for calculating a flow-rate control value calculates flow-rate control values $Q_2$, $Q_3$ of the cylinders 5, 6, and inputs them to electro-hydraulic control valves 16, 17. Pressure oil from a hydraulic source (not shown) is introduced into the electro-hydraulic control valves 16, 17 through which pressure oil is supplied to the cylinders 5, 6 for the No. 2 and No. 3 arms 2, 3 at flow rates and at directions both corresponding to the input flow-rate control values $Q_2$, $Q_3$. Pilot hydraulic pressure is produced corresponding to an amount of manual operation of operating levers 18 to 20 to be supplied to pilot ports of control valves 21 to 23. As a result, the areas of the opening of the control valves 21 to 23 and changing-over directions thereof are controlled. The control valves 21 to 23 control the flow rates of pressure oil to be sent to the cylinders 4 to 6 as well as directions thereof. The cylinders 4 to 6 are capable of arbitrarily extending or shrinking by respective operations of the operating levers 18 to 20. The cylinders 5, 6 for the No. 2 and No. 3 arms 2, 3 are respectively connected in such a manner that the flow from the control valves 22, 23 converge with the flow from the electro-hydraulic control valves 16, 17, respectively.

(2) Detailed Configuration of Each Circuit

Figure 3:
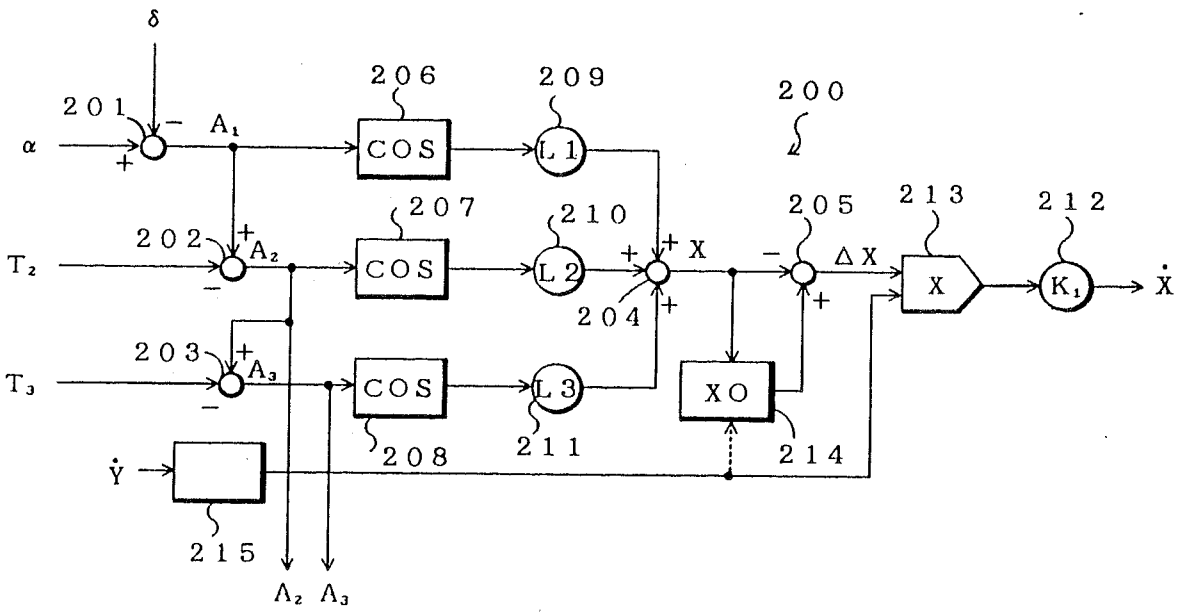

FIG. 3 shows the circuit 200 for calculating a command value for the compensating velocity, to which the set value $\delta$ for the operating direction, the angles $\alpha$, $T_2$, $T_3$, and the operating velocity command value $\dot{Y}$, and which calculates the compensating velocity command value $\dot{X}$.

Here, the compensating velocity command value $\dot{X}$ is defined as:

$$\dot{X}=K_1\cdot\Delta X\cdot|\dot{Y}| \quad (1)$$

where $K_1$ is a constant, while $\Delta X$ is a deviation between a value $X_0$ which indicates a distance in the X-direction from the origin O to the targeted locus OL during the starting of operation of the locus control lever 14 on the one hand, and a distance X in the X-direction which is determined consecutively after the operation start. This $\Delta X$ is expressed as follows:

$$\Delta X=X_0-X \quad (2)$$

The distance X in the X-direction is also expressed as follows:

$$X=L_1\cdot\cos A_1+L_2\cdot\mathrm{Cos}\,A_2+L_3\cdot\cos A_3 \quad (3)$$

As shown in FIG. 3, the X-direction distance X expressed in Formula (3) is determined by the following: an adding point 201 for outputting the angle $A_1$ which indicates a deviation $(\alpha-\delta)$ between the angle $\alpha$ with respect to the ground and the angle $\delta$ representing the operating direction; an adding point 202 which outputs the angle $A_2$ which indicates a deviation $(A_1-T_2)$ between the angle $A_1$ and the angle $T_2$; an adding point 203 for outputting the angle $A_3$ which indicates a deviation $(A_2-T_3)$ between the angle $A_2$ and the angle $T_3$; function generators 206–208 for outputting $\cos A_1-\cos A_3$; coefficient devices 209–211 for outputting $L_1\cdot\cos A_1-L_3.\cos A_3$ by multiplying these output values by coefficients $L_1$–$L_3$, respectively; and an adder 204 for outputting the X-direction distance X by adding $L_1\cdot\cos A_1-L_3\cdot\cos A_3$. During the starting of operation of the control lever 14, the X-direction distance X thus determined is stored as an initial value $X_0$ by a memory 214, and a deviation $\Delta X(=X_0-X)$ between the output X from the adder 204 and the output $X_0$ from the memory 214 is subsequently obtained at an adding point 205. In other words, the deviation $\Delta X$ of Formula (2) is obtained at the adding point 205. In addition, Formula (1) is calculated by the following: an absolute value converter 215 for outputting an absolute value $|\dot{Y}|$ of the command value $\dot{Y}$ for the velocity in the operating direction; a multiplier 213 for multiplying this output $|\dot{Y}|$ by the deviation $\Delta X$; and a coefficient device 212 for obtaining the compensating velocity command value $\dot{X}$ by multiplying the output $\Delta X\cdot|\dot{Y}|$ by the coefficient $K_1$.

Figure 5:
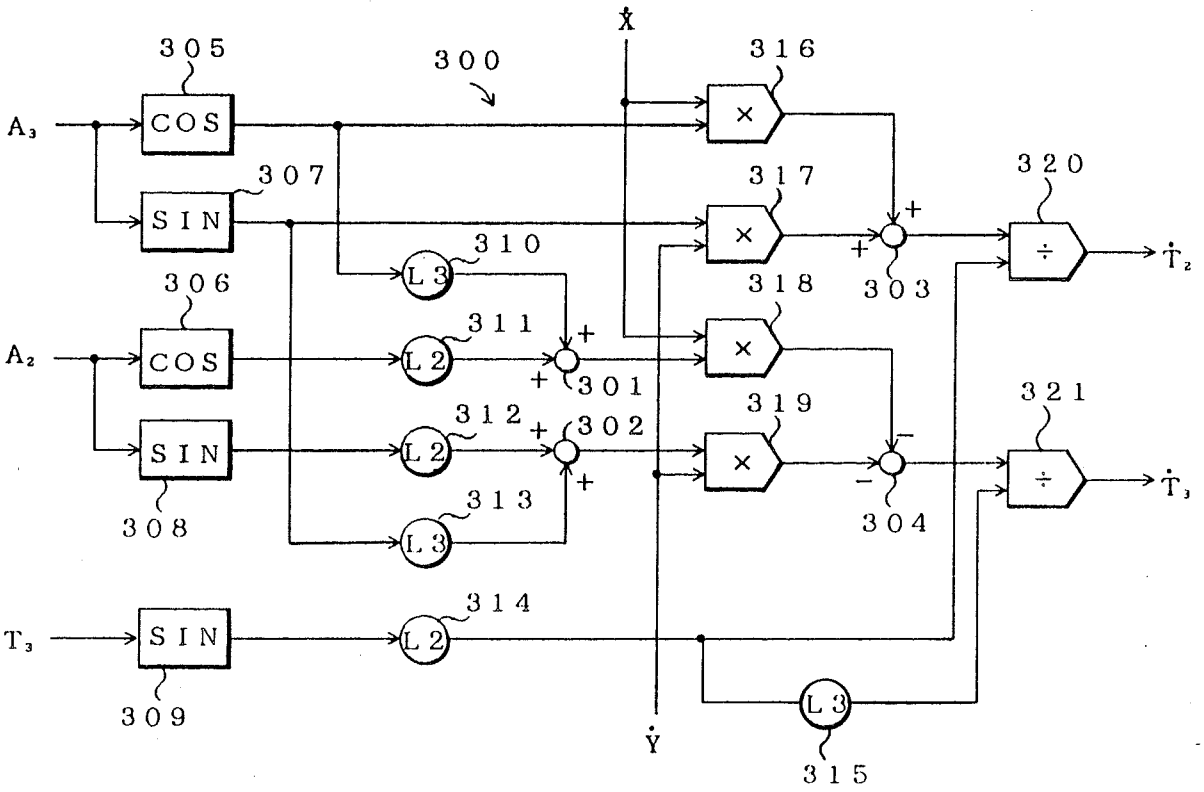

FIG. 5 shows the circuit 300 for calculating the angular velocity control value to which the angles $A_2$, $A_3$, $T_3$, the operating velocity command value $\dot{Y}$ and the comensating velocity command value $\dot{X}$ are input and which calculates the angular velocity control value $\dot{T}_2$ of the No. 2 arm 2 with respect to the No. 1 arm 1 and the angular velocity control value $\dot{T}_3$ of the No. 3 arm 3 with respect to the No. 2 arm 2.

The coordinates of a tip C of the No. 3 arm 3 are expressed as follows:

$$X=L_1\cdot\cos A_1+L_2\cdot\cos(A_1-T_2)+L_3\cdot\cos(A_1-T_2-T_3) \quad (4)$$

$$Y=L_1\cdot\sin A_1+L_2\sim\sin(A_1-T_2)+L_3\cdot\sin(A_1-T_2-T_3) \quad (5)$$

If both sides are differentiated with respect to time by assuming that the angle $A_1$ of the No. 1 arm 1 is fixed, we have $$\dot{X}=\dot{T}_2\cdot L_2\cdot\sin(A_1-T_2)+(T_2+T_3)\cdot L_3\cdot\sin(A_1-T_2-T_3) \quad (6)$$

$$\dot{Y}=-\dot{T}_2\cdot L_2\cdot\cos(A_1-T_2)-(T_2+T_3)\cdot L_3\cdot\cos(A_1-T_2-T_3) \quad (7)$$

If the above formulae are solved with respect to $\dot{T}_2$ and $\dot{T}_3$, we have $$\dot{T}_2 = \frac{\dot{X}\cdot\cos(A_1-T_2-T_3)+\dot{Y}\cdot\sin(A_1+T_2-T_3)}{L_2\cdot\sin T_3} = \frac{\dot{X}\cdot\cos A_3+\dot{Y}\sin\cdot A_3}{L_2\cdot\sin T_3} \quad (8)$$

$$\begin{aligned}\dot{T}_3 &= -\frac{1}{L_2\cdot L_3\cdot\sin T_3}[\dot{X}\{L_2\cdot\cos(A_1-T_2)+L_3\cdot\cos(A_1-T_2-T_3)\}+\dot{Y}\{L_2\cdot\sin(A_1-T_2)+L_3\cdot\sin(A_1-A_2-T_3)\}] \\ &= -\frac{1}{L_2\cdot L_3\cdot\sin T_3}\{\dot{X}(L_2\cdot\cos A_2+L_3\cos A_3)+Y\{L_2\cdot\sin A_2+L_3\cdot\sin A_3)\}\end{aligned} \quad (9)$$

Thus, the angular velocity control values $\dot{T}_2$, $\dot{T}_3$ of the No. 2 and No. 3 arms 2, 3 are determined with respect to the velocity command values $\dot{X}$, $\dot{Y}$.

As shown in FIG. 5, the circuit 300 for calculating the angular velocity control value is constituted by the following: function generators 305–309 for respectively outputting cos $A_3$, sin $A_3$, cos $A_2$, sin $A_2$, and sin $T_3$; coefficient devices 310–314 for multiplying these functions by $L_2$ or $L_3$; a coefficient device 315 for multiplying $L_2\cdot\sin T_3$ by a coefficient $L_3$; multipliers 316–319 for respectively outputting $\dot{X}$ cos $A_3$, $\dot{Y}$ sin $A_3$, $\dot{X}(L_2$ cos $A_2+L_3\cdot$cos $A_3)$, and $\dot{Y}$ $(L_2$ sin $A_2+L_3\cdot A_3)$; adding points 303, 304 for respectively outputting $(\dot{X}\cdot\cos A_3+\dot{Y}\cdot\sin A_3)$, $-\dot{X}$ $(L_2\cdot\cos A_2+L_3\cdot\cos A_3)-\dot{Y}$ $(L_2\cdot\sin A_2+L_3\cdot\sin A_3)$; and dividers 320, 321 which performs the division shown in Formulae (8), (9) on the basis of these outputs, and then output $\dot{T}_2$, $\dot{T}_3$ respectively.

Figure 6:
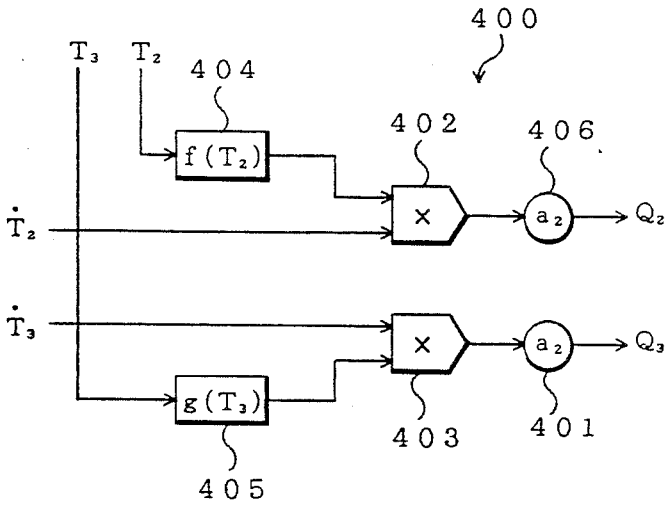

FIG. 6 shows the circuit 400 for calculating the flow-rate control value, which calculates flow-rate control values for the second and third cylinders 5, 6, i.e., input signals $Q_2$, $Q_3$ for the electro-hydraulic control valves 16, 17, on the basis of the input angles $T_2$, $T_3$ and the angular velocity control values $\dot{T}_2$, $\dot{T}_3$.

Figure 7:
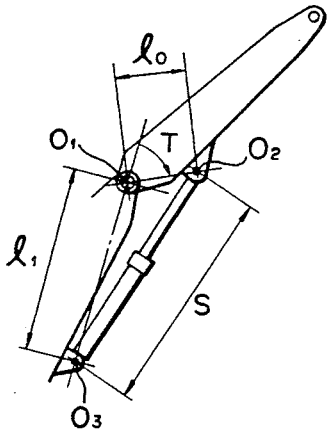

Here, S, $l_0$, $l_1$, T shown in FIG. 7 are defined as follows:

S: length of the cylinder $l_0$: distance between an arm rotating point $\mathbf{0}_1$ and a cylinder rod-side supporting point $\mathbf{0}_2$ $l_1$: distance between the arm rotating point $\mathbf{0}_1$ and a cylinder bottom-side supporting point $\mathbf{0}_3$ T: value corresponding to a relative angle of the arm (a value in which a constant is added to the relative angle of the arm)

Then the following formula holds:

$$S=\sqrt{l_0^2+l_1^2-2\,l_0\,l_1\cos(\pi-T)} \quad (10)$$

If both sides of Formula (10) are differentiated with respect to time, we have $$\dot{S}=\frac{-l_0l_1\sin(\pi-T)}{\sqrt{l_0^2+l_1^2-2l_0l_1\cos(\pi-T)}}\cdot\dot{T} \quad (11)$$

and this formula shows the relationship between the cylinder velocity $\dot{S}$ and the angular velocity $\dot{T}$ of the arm. In Formula (11), the terms excluding $\dot{T}$ are functions of T, Formula (11) can be set as $$\dot{S}=f(T)\cdot\dot{T} \quad (12)$$

where f(T) is a coefficient of link compensation, and can be set in such a manner that precalculated results can be output from the function generators.

Since a required flow rate Q can be determined if the cylinder velocity S in Formula (12) is multiplied by a cylinder area a, the flow-rate control values $Q_2$, $Q_3$ of the second and third cylinders 5, 6 can be expressed as $$Q_2=\dot{T}_2\cdot f(T_2)\cdot a_2 \quad (13)$$

$$Q_3=\dot{T}_3\cdot g(T_3)\cdot a_3 \quad (14)$$

Incidentally, since the cylinder areas $a_2$, $a_3$ as an actual matter of fact differ respectively between the rod side and the bottom side, it is necessary to use the cylinder areas $a_2$, $a_3$, as necessary, during expansion and shrinkage thereof.

To calculate Formulae (13), (14), as shown in FIG. 6, the circuit 400 for calculating the flow-rate control value comprises function generators 404, 405 for generating $f(T_2)$, $g(T_3)$, multipliers 402, 403 for calculating the cylinder velocity $\dot{S}$ shown in Formula (12), and coefficient devices 406, 401 for obtaining the flow-rate control values $Q_2$, $Q_3$ by multiplying the cylinder velocity $\dot{S}$ by the cylinder areas $a_2$, $a_3$.

A description will now be given of the operation of this apparatus.

When a power switch (not shown) is turned on, in the circuit 200 for calculating the command value for the compensating velocity, the position of the tip of the No. 3 arm 3 in the compensating direction, i.e., the X coordinate, is calculated on the basis of the angles $\alpha$, $T_2$, $T_3$ respectively detected by the angle detectors 11–13 as well as the operating direction $\delta$ set by the operating direction setter 15. The X coordinate at the point of time of starting the operation of the control lever 14 is stored in the memory 214 as the initial value $X_0$. The line which passes through this $X_0$ and is parallel with the Y-axis is the targeted locus OL (FIG. 4A), while the direction which forms the angle δ with respect to the vertical direction is the direction of the targeted locus. The deviation ΔX between the X-coordinate X which is consecutively calculated during the operation and the initial value $X_0$ at the tip of the No. 3 arm 3 is calculated at the adding point 205. When the operating velocity command value $\dot{Y}$ for the tip of the No. 3 arm 3 in the operating direction (the Y-axis direction) is output by the operation of the control lever 14, the circuit 200 for calculating the compensating velocity command value outputs the compensating velocity command value $\dot{X}$ by multiplying the product of the the deviation ΔX and the absolute value $|\dot{Y}|$ of the operating velocity command value $\dot{Y}$ by the constant $K_1$. If the deviation ΔX is zero, the compensating velocity command value $\dot{X}$ is zero.

On the basis of this compensating velocity command value $\dot{X}$, the operating velocity command value $\dot{Y}$, and the angles $A_2$, $A_3$, and $T_3$, the circuit 300 for computing the angular velocity control value calculates the angular velocity control values $\dot{T}_2$, $\dot{T}_3$ of the No. 2 and No. 3 arms 2, 3. These angular velocity control values $\dot{T}_2$, $\dot{T}_3$ undergo link compensation by the circuit 400 for calculating the flow-rate control value, and are converted into the flow-rate control values $Q_2$, $Q_3$ of the second and third cylinders 5, 6. These flow-rate control values $Q_2$, $Q_3$ are supplied to the electro-hydraulic control valves 16, 17, whereby the pressure oil from the hydraulic source is supplied through electro-hydraulic control valves 16, 17 to the second and third cylinders 5, 6 respectively in predetermined flow directions and at predermined flow rates. As a result, the No. 2 and No. 3 arms 2, 3 rotate, and the locus of the tip of the No. 3 arm 3 is controlled in the operating direction. Namely, the tip of the No. 3 arm 3 moves along the targeted locus OL. For instance, if δ=0, the sheet pile can be driven in vertically with respect to the horizontal plane.

Thus, in this embodiment, the angular velocities of the No. 2 and No. 3 arms 2, 3 are controlled in such a manner that the tip of the No. 3 arm 3 moves along the targeted locus OL in the operating direction at a predetermined speed. Simultaneously, the deviation ΔX in the direction of the X-axis with respect to the targeted locus OL of the tip of the No. 3 arm 3 is calculated, and the positional feedback control is effected on the basis of this deviation ΔX thus calculated. Accordingly, the positional accuracy of the locus depicted by the tip of the No. 3 arm is improved remarkably as compared with the conventional open loop control without any positional feedback controls. In addition, even if the operating lever 18 for the No. 1 arm 1 is operated during the operation of the control lever 14 so that the angle α of the No. 1 arm 1 with respect to the ground is altered, the locus control through which the tip of the No. 3 arm moves along the targeted locus OL in correspondence with variations in the angle α with respect to the ground can be performed continuously.

Figure 8:
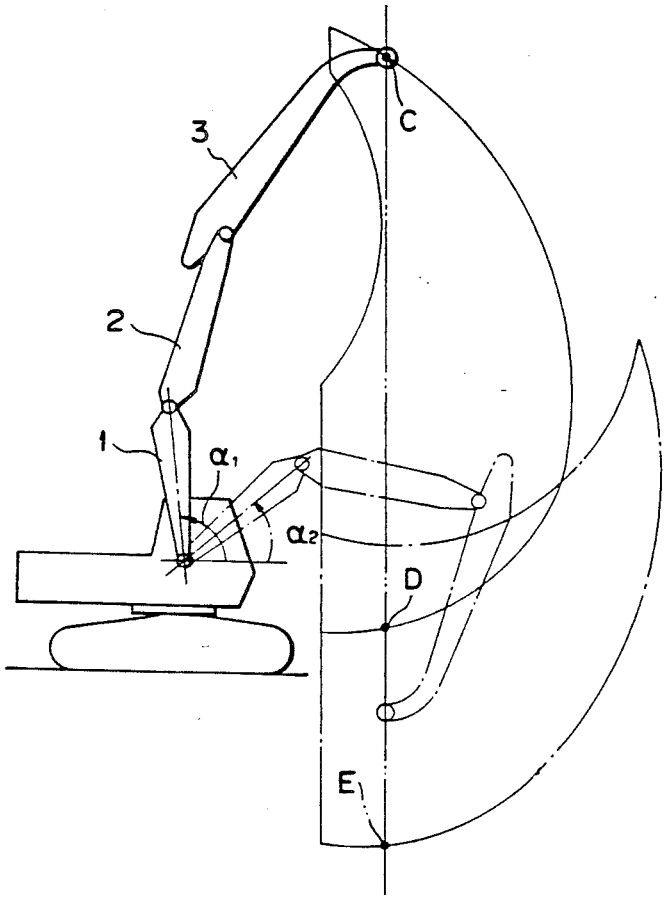

For instance, if the angle α of the No. 1 arm 1 with respect to the ground is fixed to $\alpha_1$, as shown in FIG. 8, the tip of the No. 3 arm 3 can move vertically from a point C to a point D, but cannot continuously move vertically to a point E by passing through the point D. Accordingly, if the No. 1 arm 1 is operated manually while controlling the locus of the tip of the No. 3 arm 3 by means of the control lever 14 so that the tip of the No. 3 arm 3 moves from the point C to the point D on the targeted locus and the angle of the No. 1 arm with respect to the ground varies from $\alpha_1$ to $\alpha_2$, the tip of the No. 3 arm 3 can be continuously moved vertically from the point C to the point E, thereby remarkably improving the operating efficiency.

In addition, in this embodiment, since the operating direction δ which indicates the direction of the targeted locus can be set arbitrarily by the operating direction setter 15 to control the locus depicted by the tip of the No. 3 arm 3 in the arbitrary direction, it is possible to perform not only the vertical execution of the sheet piles and the execution using the drill but also the horizontal execution and diagonal execution. For instance, setting that δ to be 90 degrees causes the tip of the No. 3 arm 3 to be moved horizontally, whereby the positioning of the sheet pile and the drill can be extremely facilitated. Setting that δ to be 45 degrees causes the tip of the No. 3 arm 3 to be moved diagonally.

It should be noted that, in applying the present invention, the respective constituent elements of the above-described embodiment can be arranged as follows:

(1) The industrial vehicle may be constituted by only the No. 2 and No. 3 arms 2, 3 which are subject to the above-described locus control, by omitting the No. 1 arm 1. The appended claims (1) to (10) are described in correspondence with this aspect.

Figure 10:
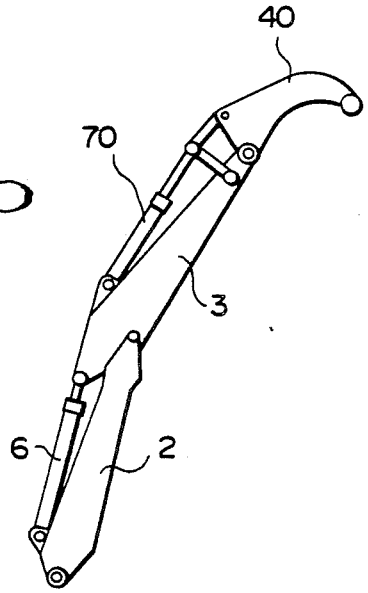

(2) In addition, as shown in FIG. 10, the No. 4 arm 40 may be provided revolvably to the tip of the No. 3 arm 3 by means of a fourth cylinder 70. In this case, $L_3$, $T_3$ in Formulae (8), (9) are substituted by $L_3'$, $T_3'$ as described below.

Figure 11:
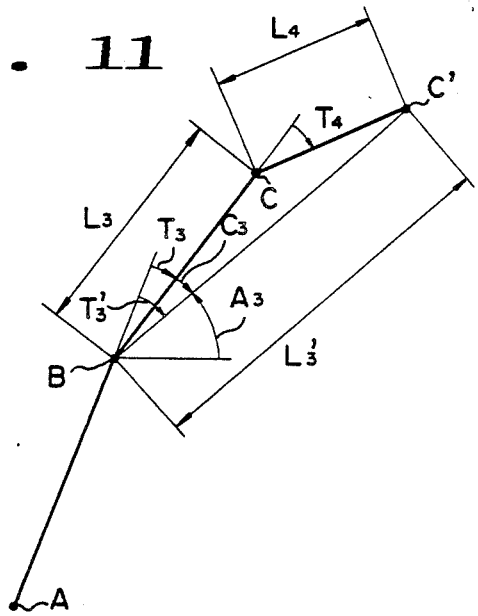

FIG. 11 is a diagram illustrating a coordinate system in a case in which the No. 4 arm 40 is added, and in this diagram:

$L_3'$: distance between the point B (the point of supporting the movement of the No. 3 arm) and a point C' (a point of coupling the operating attachment to the tip of the No. 4 arm 40)

$T_3'$: angle formed by an extension of the segment AB and the segment BC', and $T_3'=T_3+C_3$ where $C_3$: angle formed by the segment BC and the segment BC'

Here, if it is assumed that the length of the No. 4 arm 40 (the distance between the points C and C') is $L_4$ and the angle of the No. 4 arm 40 (the angle formed by an extension of the segment BC and the segment CC') is $T_4$, we have $$L_3' = \sqrt{L_3^2 + L_4^2 - 2L_3 \cdot L_4 \cos(\pi - T_4)} \tag{15}$$

$$C_3 = \cos^{-1}\left(\frac{L_3^2 + L_3'^2 - L_4^2}{2L_3 \cdot L_3'}\right) \tag{16}$$

Therefore, if $T_4$ is detected by the angle detector, it is possible to control the locus of the tip of the No. 4 arm 40 in the same way as described above. Namely, even when the No. 4 arm 40 is being operated manually, the positional feedback mentioned above functions, so that the tip of the No. 4 arm 40 can moves along the targeted locus.

(3) Although the arms 2, 3 are driven by the hydraulic cylinders 5, 6, it is possible to use other hydraulic or electric actuators, such as hydraulic motors, hydraulic rotary actuators, instead of the hydraulic cylinders 5, 6.

(4) Although it has been described that a vibro-hammer and an earth auger can be used, various other types of operating attachment can be used.

(5) Although the angle $\alpha$ of the No. 1 arm 1 with respect to the ground is detected directly, an arrangement may alternatively provided such that both the angle of the No. 1 arm 1 relative to the revolving super structure and the angle of inclination of the industrial vehicle body are detected, and the angle $\delta$ of the No. 1 arm 1 with respect to the ground is calculated from these two angles.

(6) If the operating direction is fixed (e.g., the execution is effected only vertically), the operating direction setter 15 which is adapted to manually and arbitrarily set the angle $\alpha$ can be omitted. Even in this case, however, a signal generator which generates a fixed signal such $\delta=0$ or the like is necessiated.

(7) A switch can be provided between the operating direction setter 15 and the circuit 200 for calculating the command value for the compensating velocity. In case the switch may be used so that the vertical direction is set by the turning on thereof and a desirable direction, e.g., the horizontal direction, is set by the turning off thereof, two directions of the locus can be changed over very easily.

Figure 4A:
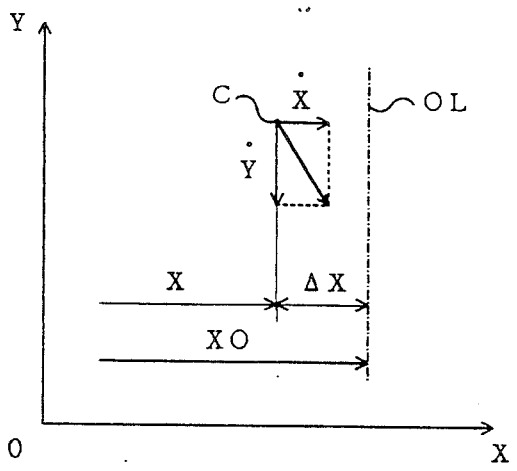
FIG. 4A is a graph illustrating command values for the operating and compensating velocities.
Figure 4B:
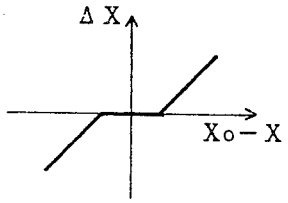
FIG. 4B is a graph illustrating the characteristics of a deviation $\Delta X$.

(8) The above-described deviation $\Delta X$ in the X-direction may be provided with characteristics shown in FIG. 4B and may be determined from $\Delta X=f(X_0-X)$. As a result, the stability of control can be ensured. In addition, it is possible to improve he accuracy of the position of the tip of the arm at the low speed by rendering the nonsensitive region at $\Delta X=0$ variable in correspondence with $|\dot{Y}|$.

Figure 4C:
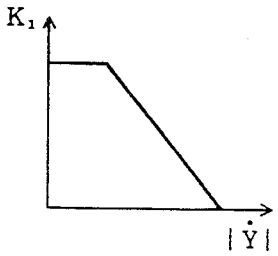
FIG. 4C is a graph illustrating the characteristics of a constant $K_1$.

(9) The aforementioned $K_1$ may be provided with characteristics shown in FIG. 4C and may be determined from $K_1=f(|\dot{Y}|)$. As a result, hunting during a high-speed operation can be prevented.

(10) The angle detectors and the operating levers are not restricted to the potentiometer type, and those using a magnetic resistor, those using a differential coil, those using a magnetic rotary encoder, etc. may be used.

(11) The circuits and formulae in the embodiment are not restricted to them. In particular, although an absolute coordinate system is made to rotate in accordance with the operating direction $\delta$, arithmetic processing mentioned above may be carried out without the rotation of the absolute coordinate system.

[Second and Third Embodiments]

Second and third embodiments of the present invention will be described hereafter with reference to FIGS. 13 to 15 and FIGS. 16 to 18, respectively. In the first embodiment, the direction $\delta$ of the targeted locus for the tip of the No. 3 arm 3 is set arbitrarily by the operating direction setter 15 prior to starting the operation. In these second and third embodiments, however, the direction in which the operating attachment 7 is installed during the operation or at the time of starting of the operation is detected to be set as the direction $\delta$ of the targeted locus, thereby to control the arm movement or to perform the locus control.

A description will be given of the background of the second embodiment.

When the apparatus of the first embodiment is operated by using as the operating attachment the vibrohammer 7 or the auger drill unit 8 respectively shown in FIG. 9A and 9B, and when an attempt is made to operate the sheet pile PL or the auger drill DR, for instance, in the diagonal direction, it is necessary to set the operating direction in a desired direction by the operating direction setter 15, and to set up the sheet pile PL or the auger drill DR in alignment with the operating direction $\delta$ set by the operating direction setter 15 at the start of the execution of the work. If the operating direction $\delta$ set by the operating direction setter 15 is not aligned with the actual direction of the sheet pile PL or the auger drill DR, as the execution of the work progresses, the axis of the sheet pile PL or the auger drill DR deviates from the targeted locus. Since the tip portion of the sheet pile PL or the auger drill DR is restrained in the ground, a force in a bending direction (an eccentric load) is consequently applied to the sheet pile PL or the auger drill DR. Hence, there is the possibility of the sheet pile PL or the auger drill DR becoming broken. Therefore, considerable time must be spent in setting the direction of the sheet pile PL or the auger drill DR before starting the operation.

In addition, even when the operating direction setter 15 for manually inputting $\delta$ arbitrarily is omitted, and only the vertical operation is executed, unless the sheet pile PL or the auger drill DR is oriented vertically at the start of the execution of the work, the direction of the sheet pile PL or the auger drill DR being operated becomes deviated from the vertical direction, so that there is also the possibility of these attachments becoming broken. Hence, it also takes time in orienting the sheet pile PL or the auger drill DR. Furthermore, breakage is also liable to occur when the direction of the sheet pile PL or the auger drill DR deviates from the direction of the targeted locus midway in the execution of the work.

A description will be given of the background of the third embodiment.

Figure 12:
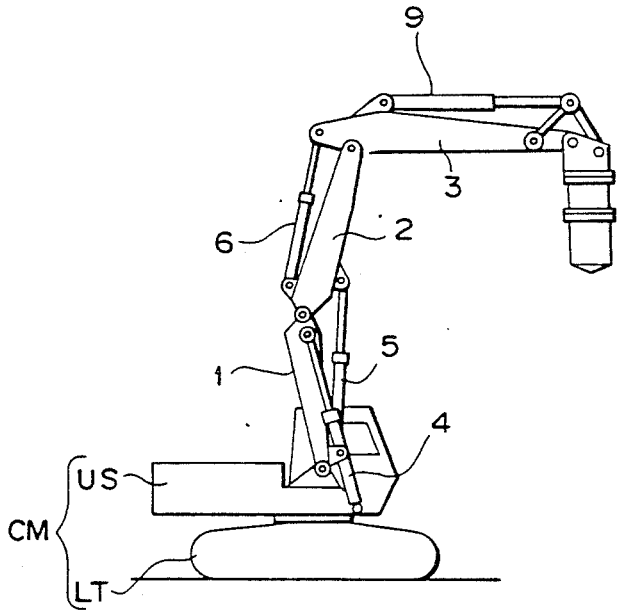

As shown in FIG. 12, when the arm movement is controlled in an industrial vehicle in which the direction of installation of an operating attachment, e.g., an excavating bucket, is made adjustable by the cylinder 9, the excavating direction may be generally set to the direction of installation of the operating attachment, thereby to control the arm movement through the above-described locus control technique. With an industrail vehicle of this type, frequent change of the excavating direction in correspondence with the operation causes the direction of the locus to be reinput in response to each change of the excavating direction by operating the operating direction setter 15, so that the operation becomes very complicated.

The second and third embodiments are aimed at overcoming the aforementioned problems.

Figure 13:
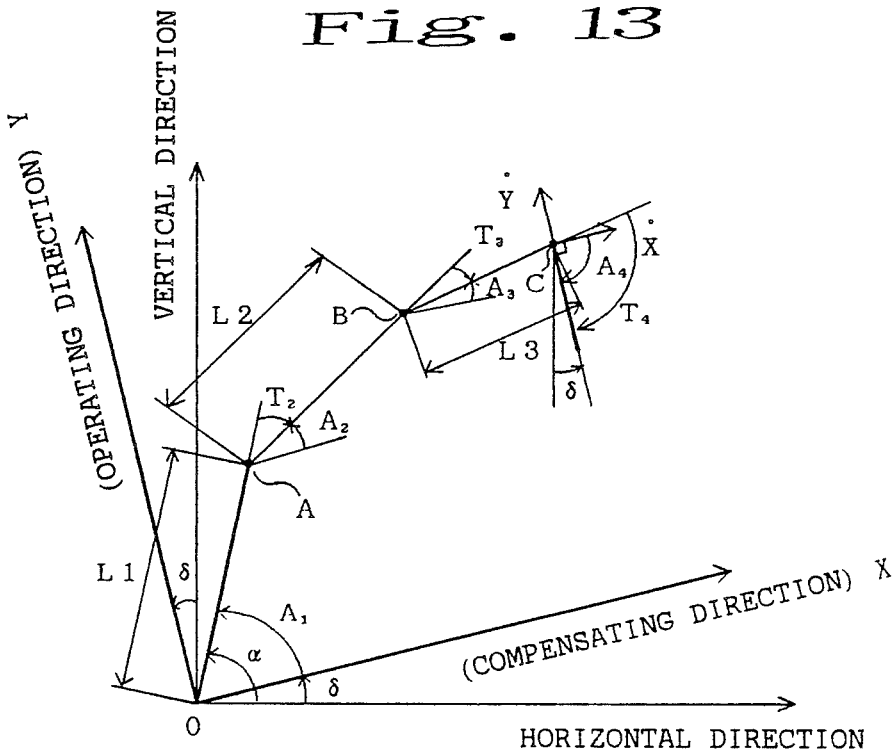

FIG. 13 shows a coordinate system of the industrial vehicle applied to the second and third embodiments, and the following description will be based on this coordinate system. In FIG. 13, the same components as those shown in FIG. 1 are denoted by the same reference numerals, and a description will be given of only points of difference.

In this embodiment, $A_4$, $T_4$, $\delta$ are defined as follows:

$A_4$: angle formed by the operating attachment with respect to the X-axis $T_4$: angle formed by the operating attachment with respect to the extension of the segment BC $\delta$: angle formed by the axis of the operating attachment with respect to the vertical direction and defining (the direction of installation of the operating attachment)

where $A_1=\alpha-\delta$ $A_2=A_1-T_2$ $$A_3 = A_2 - T_3 = A_1 - T_2 - T_3$$

$$A_4 = A_3 - T_4 = A_1 - T_2 - T_3 - T_4$$

If the coordinate axis is determined by assuming that the direction δ of installation of the operating attachment is the operating direction, we have $$A_4 = -\pi/2$$

Hence, the operating direction δ can be calculated from the following formula:

$$\delta = \alpha - T_2 - T_3 - T_4 + \pi/2 \quad (17)$$

(Configuration of the Apparatus of the Second Embodiment)

Figure 14:
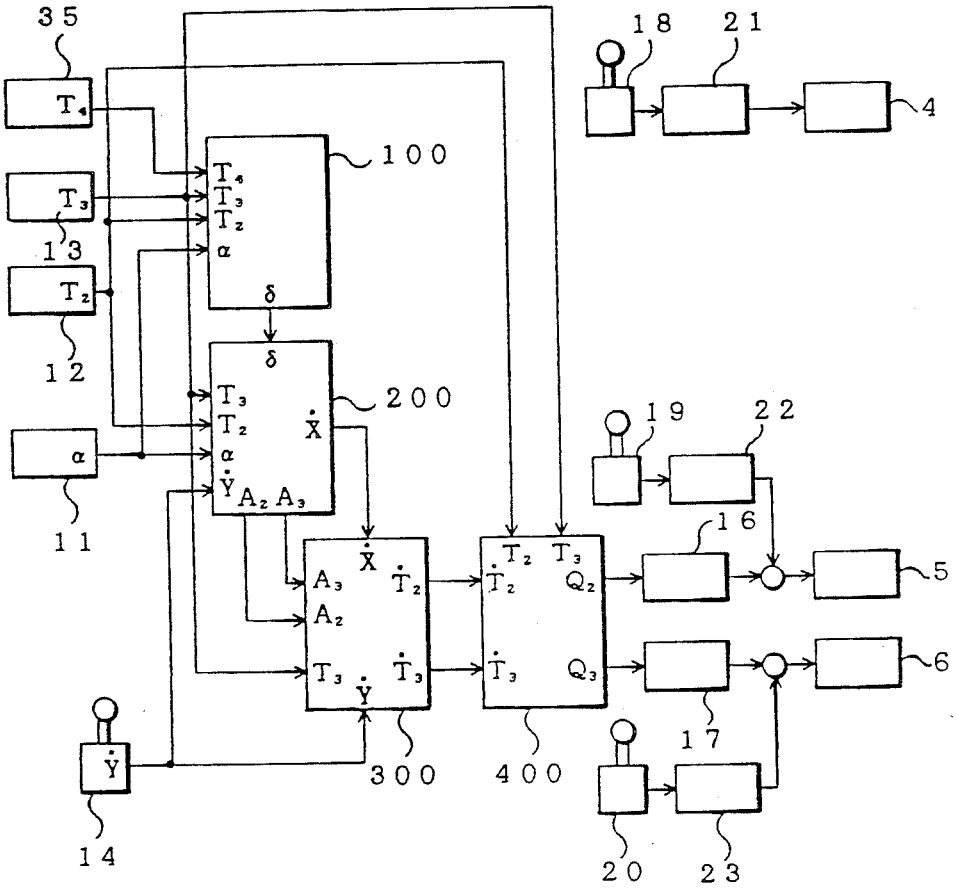

Referring now to FIG. 14, a description will now be given of an overall configuration of the controlling apparatus in accordance with the second embodiment wherein the present invention is applied to the industrial vehicle shown in FIG. 9A or 9B in which an operating attachment is connected to the tip of the No. 3 arm 3 by means of a pin. The same portions as those of the first embodiment shown in FIG. 2 are denoted by the same reference numerals, and a description will be given centering on points of difference.

An operating direction calculating circuit 120 is provided in place of the operating direction setter 15, and an angle detector 35 is provided for detecting the angle $T_4$ formed by the No. 3 arm 3 relative to the direction of installation of the operating attachment 7 or 8. This angle detector 35 is installed at the point of supporting the rotation of the operating attachment and is constituted by a known lever mechanism and potentiometer. The angles α, $T_2$ to $T_4$ respectively detected by the angle detectors 11 to 13 and 35 are input to the operating direction calculating circuit 120, and the angle δ of the axis of the operating attachment with respect to the vertical direction (which defines the direction of installation of the operating attachment and that of the targeted locus) is calculated on the basis of these inputs, and is then input to an operating direction input terminal of the circuit 200 for calculating the command value for the compensating velocity.

At this juncture, the circuit 200 for calculating the command value of the compensating velocity calculates the command value $\dot{X}$ for the velocity in the compensating direction and the angles $A_2$, $A_3$ in the same way as the first embodiment, and inputs them to the circuit 300 for calculating the angular velocity control value. The circuit 300 for calculating the angular velocity control value calculates the angular velocity control values $\dot{T}_2$, $\dot{T}_3$ of the No. 2 and No. 3 arms 2, 3 in the same way as the first embodiment, and inputs them to the circuit 400 for calculating the flow-rate control value. Similarly, the circuit 400 for calculating the flow-rate control value calculates the flow-rate control values $Q_2$, $Q_3$ of the cylinders 5, 6 in the same way as the first embodiment, and inputs them to the electro-hydraulic control valves 16, 17. The electro-hydraulic control valves 16, 17, the operating levers 18–20, and the control valves 21–23 and their relationships of connection are entirely identical with those of the first embodiment, so that a description thereof will be omitted.

Figure 15:
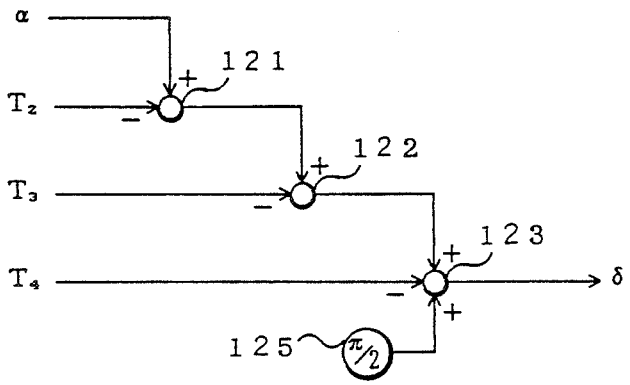

FIG. 15 shows the operating direction calculating circuit 120. The direction δ of installation of the operating attachment is determined by calculating Formula (17) by means of a π/2 setter 125 and adding points 121 to 123, and is input to an operating direction input terminal of the circuit 200 for calculating the command value for the compensating velocity.

Since the other aspects of the circuit configuration are identical with those of the first embodiment, a description thereof will be omitted.

The operation of this apparatus will be described hereafter.

In the operating direction calculating circuit 120, the angle δ of installation of the operating attachment with respect to the vertical direction is calculated on the basis of the angles α, $T_1$, $T_2$, $T_3$, and $T_4$ respectively detected by the angle detectors 11–13 and 35. The X- and Y-coordinates with this angle δ set as the operating direction are thereby determined. This angle δ may be altered each time when the angle $T_4$ of installation of the operating attachment changes during the operation. On the basis of this operating direction δ and the angles α, $T_2$, $T_3$ detected by the angle detectors 11–13, the circuit 200 for calculating the command value for the compensating velocity calculates the position of the tip of the No. 3 arm 3 in the compensating direction, i.e., the X-coordinate thereof. The X-coordinate at the start of the operation of the control lever 14 is stored in the memory 214 as the initial value $X_0$. The line which passes through this $X_0$ and is parallel with the Y-axis is the targeted locus OL (FIG. 4A), while the direction which forms the angle δ with respect to the vertical direction is the direction of the targeted locus along which the tip of the No. 3 arm 3, i.e., the connecting point of the operating attachment moves. The deviation ΔX between the X-coordinate X and the initial value $X_0$ at the tip of the No. 3 arm 3 which is consecutively calculated during the operation is calculated at the adding point 205 (FIG. 3). When the operating velocity command value Y for the tip of the No. 3 arm 3 in the operating direction (the Y-axis direction) is output by the operation of the control lever 14, the circuit 200 for calculating the compensating velocity command value outputs the compensating velocity command value $\dot{X}$ by multiplying the product of the deviation ΔX and the absolute value $|\dot{Y}|$ of the operating speed command value $\dot{Y}$ by the constant $K_1$. If the deviation ΔX is zero, the compensating velocity command value $\dot{X}$ is zero.

On the basis of this compensating velocity command value $\dot{X}$, the operating velocity command value $\dot{Y}$, and the angles $A_2$, $A_3$, and $T_3$, the circuit 300 for computing the angular velocity control value calculates the angular velocity control values $T_2$, $T_3$ of the No. 2 and No. 3 arms 2, 3. These angular velocity control values $T_2$, $T_3$ undergo link compensation by the circuit 400 for calculating the flow-rate control value to be converted into the flow-rate control values $Q_2$, $Q_3$ of the second and third cylinders 5, 6. These flow-rate control values $Q_2$, $Q_3$ are supplied to the electro-hydraulic control valves 16, 17 through which the pressure oil from the hydraulic source is supplied to the second and third cylinders 5, 6 in predetermined directions and at predermined flow rates. As a result, the No. 2 and No. 3 arms 2, 3 rotate so as to control movement of the tip of the No. 3 arm 3 along the targeted locus orientated in the direction δ of installation of the operating attachment.

Thus, in the second embodiment, the angle of installation of the operating attachment with respect to the vertical direction is set as the angle δ defining operating direction, and the angular velocities of the No. 2 and No. 3 arms 2, 3 are controlled in such a manner that the tip of the No. 3 arm 3 moves in the operating direction along the targeted locus at a predetermined speed. Meanwhile, simultaneously as this control is effected, the deviation of the tip of the No. 3 arm 3 with respect to the targeted locus in the direction of the X-axis is detected, and the positional feedback control based on this deviation is also carried out. In consequence, if the predetermined operating direction is fixed as in the case of the first embodiment, the sheet pile PL or the auger drill DR is broken when the angle of the operating attachment is substantially deviated from the operating direction thereof. In accordance with this second embodiment, however, since the direction of the targeted locus is consecutively altered in the direction of the axis of the sheet pile PL or the auger drill DR which changes with the execution of the work, such breakage can be prevented. Furthermore, in the execution of driving in the sheet pile PL longitudinally, in the first embodiment, it takes time in aligning the sheet pile PL or the auger drill DR with the predetermined operating direction, and the operating efficiency is therefore poor. In the second embodiment, however, since the direction of the targeted locus is automatically set to the direction of the sheet pile PL or the like, the operating efficiency can be improved.

Furthermore, since the operating direction setter is not required, the apparatus can be constructed at lower costs. In addition, since there is no need to install the operating direction setter in the narrow space of the operator's cabin, the roominess of the operator's cabin can be ameliorated.

(Configuration of the Third Embodiment)

Figure 16:
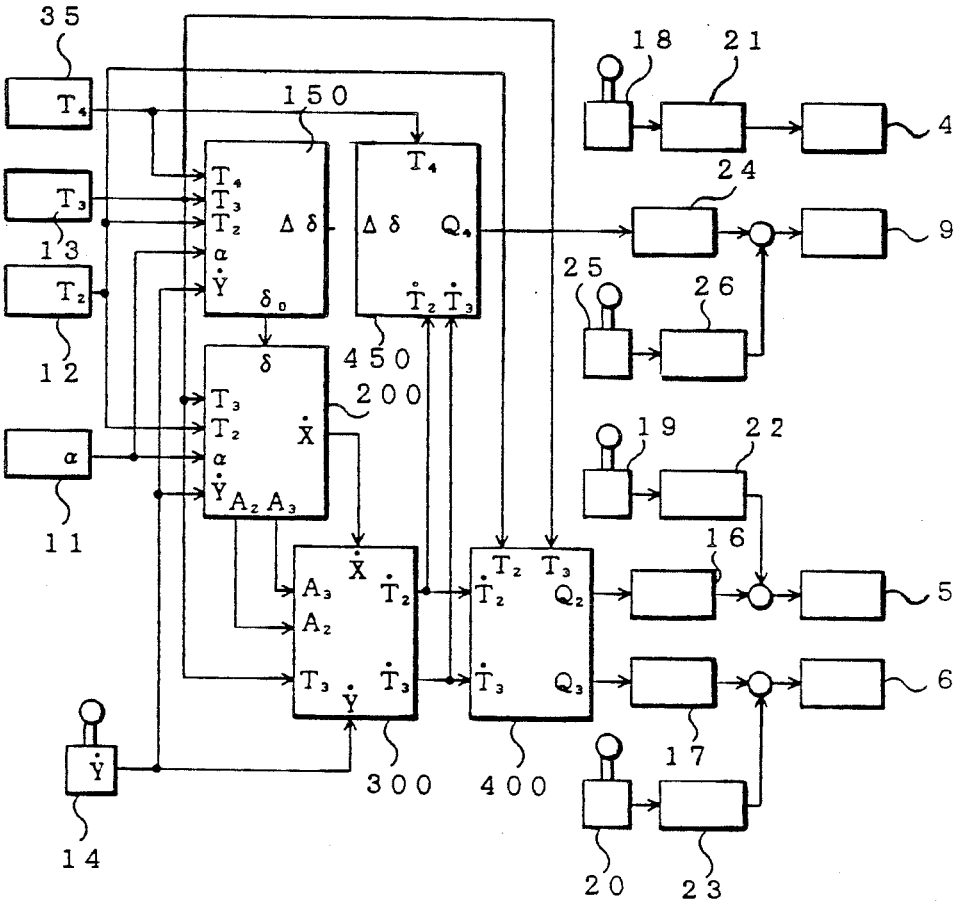

FIG. 16 illustrates a configuration of the arm movement controlling apparatus in accordance with the third embodiment in which the angle of installation of the operating attachment on the No. 3 arm 3 can be varied by means of the cylinder 9, as shown in FIG. 12. The same portions as those shown in FIGS. 2 and 14 are denoted by the same reference numerals, and a description will be given by centering on points of difference.

An operating direction calculating circuit 150 is provided in place of the operating direction calculating circuit 120 shown in FIG. 14. The angle $\delta_0$ of the installation of the operating attachment at the start of the operation is calculated by this operating direction calculating circuit 150 and is stored as the operating direction δ. Subsequently, an angular deviation Δδ between the angle δ of installation of the operating attachment and the operating direction $\delta_0$ is calculated during the operation and input to a second circuit 450 for calculating a flow-rate control value for the cylinder 9. In addition, the operating direction $\delta_0$ at the start of the operation is input to the operating direction input terminal of the circuit 200 for calculating the command value for the compensating velocity.

Figure 17:
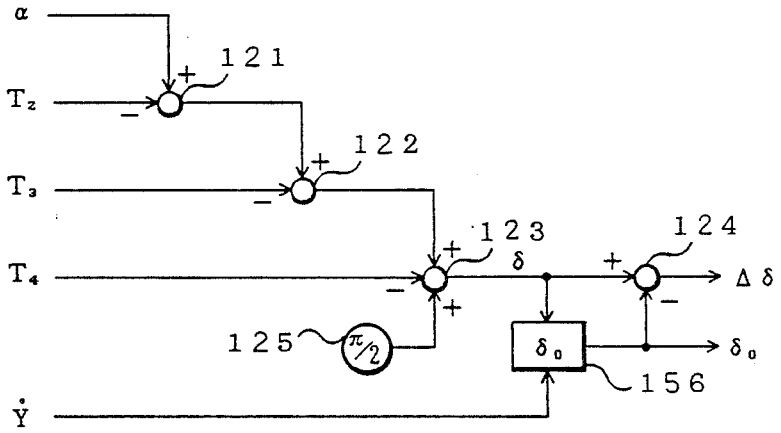

As shown in FIG. 17, the operating direction calculating circuit 150 is arranged such that a memory 156 for storing the initial angle $\delta_0$ is added to the operating direction calculating circuit 120 shown in FIG. 15. This operating direction calculating circuit 150 is adapted to obtain the deviation Δδ between the angle $\delta_0$ of installation of the operating attachment at the operation start and the angle δ of the operating attachment which is calculated consecutively by the adding points 121–123 and the $\pi/2$ setter 125 during the operation.

The second circuit 450 for calculating the flow-rate control value is used to control the driving of the cylinder 9 in such a manner that the angle δ of the installation of the operating attachment will be maintained at a fixed level even if the posture of the No. 2 and No. 3 arms 2, 3 changes consecutively.

The angular deviation Δδ, the angle $T_4$, and the angular velocity control control values $\dot{T}_2$, $\dot{T}_3$ are input to the second circuit 450 for calculating the flow-rate control value, which calculates the flow-rate control value $Q_4$ supplied to the electro-hydraulic control valve 24 for the cylinder 9. Reference numeral 25 denotes an operating lever for the cylinder 9, while numeral 26 denotes a control valve which is changed over and controlled by the operating lever 25. The arrangement is provided such that the cylinder 9 can be driven by the operation of the electro-hydraulic control valve 24 or the control valve 26. The other aspects of the configuration are identical to those of the apparatus shown in FIGS. 2 and 14, and a description thereof will be omitted.

Figure 18:
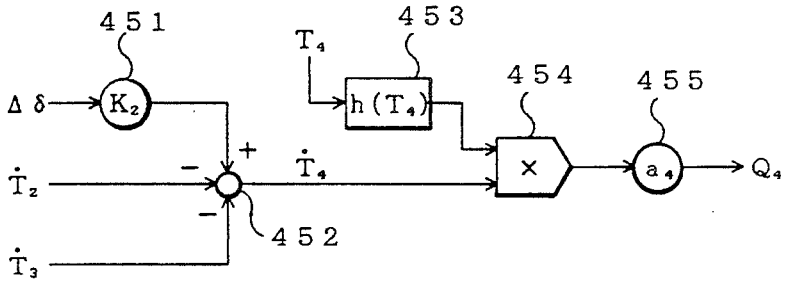

FIG. 18 shows the second circuit 450 for calculating the flow-rate control value. To maintain the angle of installation of the operating attachment at a fixed level (in the direction of the Y-axis), it suffices if the angular velocity control value $\dot{T}_4$ of the operating attachment is controlled to the angular velocity in which the numeral of a sum of the angular velocity control values $\dot{T}_2$, $\dot{T}_3$ of the No. 2 and No. 3 arms 2, 3 is inverted. The angular velocity control value $T_4$ can be expressed by the following formula:

$$\dot{T}_4 = -(\dot{T}_2 + \dot{T}_3) \tag{18}$$

In addition, feedback through the angular deviation Δδ with respect to the operating direction is effected in this third embodiment to improve the accuracy of the angle and so that the No. 1 arm 1 can be driven arbitrarily. Thus, in this embodiment, the angular velocity control value $\dot{T}_4$ is set as follows:

$$\dot{T}_4 = K_2\Delta\delta - \dot{T}_2 - \dot{T}_3 \tag{19}$$

As shown in FIG. 18, the angular velocity control value $\dot{T}_4$ of the operating attachment is obtained by multiplying the angular deviation Δδ with respect to the operating direction by a constant $K_2$ by means of a coefficient device 451 and then by adding this product and the angular velocity control values $\dot{T}_2$, $\dot{T}_3$ for the No. 2 and No. 3 arms 2, 3 by means of an adding point 452. The flow-rate control value $Q_4$ of the operating attachment can be obtained by using this angular velocity control value $\dot{T}_4$, as in the case of FIG. 6. Accordingly, as shown in FIG. 18, the second circuit 450 for calculating the flow-rate control value is provided with a function generator 453 for outputting a link compensation coefficient ($h(T_4)$) for the operating attachment, a multiplier 454 for calculating the cylinder velocity, and a coefficient device 455 for multiplying the cylinder velocity by a cylinder area $a_4$.

The operation of this third embodiment will be described hereafter.

The turning of a power switch (not shown) starts the operation, as in the case of the first embodiment. First, the angle δ of installation of the operating attachment with respect to the vertical direction is calculated by the operating direction calculating circuit 150. The X- and Y-coordinates with this installation angle $\delta$ defining the operating direction are then determined. The angle $\delta$ at the start of the operation is stored in a memory 156 as the initial angle $\delta_0$ (this $\delta_0$ defines the fixed direction of the targeted locus during the operation) and is input to the circuit 200 for calculating the command value for the compensating velocity. On the basis of the input $\delta_0$, $T_2$, $T_3$, and $\alpha$, the circuit 200 for calculating the command value for the compensating velocity determines the angles $A_2$ and $A_3$ of the No. 2 and No. 3 arms 2, 3 with respect to the X-axis. In addition, the circuit 200 determines the compensating velocity command value $\dot{X}$ from Formula (1), as described above. On the basis of the input $\dot{X}$, $\dot{Y}$, $A_2$, $A_3$, and $T_3$, the circuit 300 for calculating the angular velocity control value determines the angular velocity control values $\dot{T}_2$ and $\dot{T}_3$ so that the tip of the No. 3 arm 3, i.e., the coupling point of the operating attachment, moves along the targeted locus orientated in the direction $\delta_0$. A first circuit 400 for calculating a control value determines the flow-rate control values $Q_2$ and $Q_3$, as described above, on the basis of the input $T_2$, $T_3$, $\dot{T}_2$, and $\dot{T}_3$.

Meanwhile, the angular deviation $\Delta\delta$ with respect to the operating direction of the operating attachment, which is determined by the operating direction calculating circuit 150, together with the angular velocity control values $T_2$, $T_3$ for the No. 2 and No. 3 arms 2, 3, is input to the second circuit 450 for calculating the flow-rate control value in which the angular velocity control value $T_4$ for the operating attachment is first calculated. Then, link compensation described above is carried out so as to obtain the flow-rate control value $Q_4$ for the cylinder 9 for the operating attachment. This flow-rate control value $Q_4$ is supplied to the electro-hydraulic control valve 24, which, in turn, supplies pressure oil of a predetermined flow rate to the cylinder 9, thereby effecting control in such a manner that the angle of installation of the operating attachment with respect to the vertical direction coincides with the operating direction $\delta_0$.

Accordingly, the arm movement is controlled with the posture of the operating attachment fixed, and, as in the case of the second embodiment, the operating direction setter for manually inputting in a desired direction becomes unnecessary, so that the operating features can be improved appreciably. In addition, since both the positional and angular feedback-controls are effected by means of the deviation $\Delta X$ in the direction f the X-axis and the deviation $\Delta\delta$ of the installation angle of the operating attachment, the positional accuracy of the position of the tip of the No. 3 arm and the postural accuracy of the operating attachment can be enhanced.

It should be noted that a main objective of the second and third embodiments is to set the direction of the targeted locus by the angle of installation of the operating attachment midway in the operation or at the start of the operation, so that the feedback of the deviation $\Delta X$ in the X-direction and the angular deviation $\Delta\delta$ are not essential. Furthermore, an arrangement may be provided such that the apparatus is constituted only by the No. 2 and No. 3 arms 2, 3 which are subject to the above-described locus control, as in the case of the first embodiment. In addition, a hydraulic motor, a hydraulic rotary actuator, or an electric actuator may be used in place of the hydraulic cylinder. Moreover, it is possible to use operating attachments other than the vibro-hammer, the earth auger, and the excavating bucket. Additionally, the angle $\alpha$ of the No. 1 arm 1 with respect to the ground may be determined by the angle of inclination of the industrial vehicle body and the angle of the No. 1 arm 1 relative to the body. Further, the angle of installation of the operating attachment with respect to the vertical direction may be detected directly by such as a pendulum-type angle detector, and that angle may be displayed on a display or the like. The angle displayed allows the operator to freely set the angle of the installation of the operating attachment without an assistant who gives a signal to the operator.

[Fourth Embodiment]

Referring now to FIGS. 19 to 30, a fourth embodiment will be described. This fourth embodiment is also applied to the industrial vehicle shown in FIG. 9A.

Figure 19:
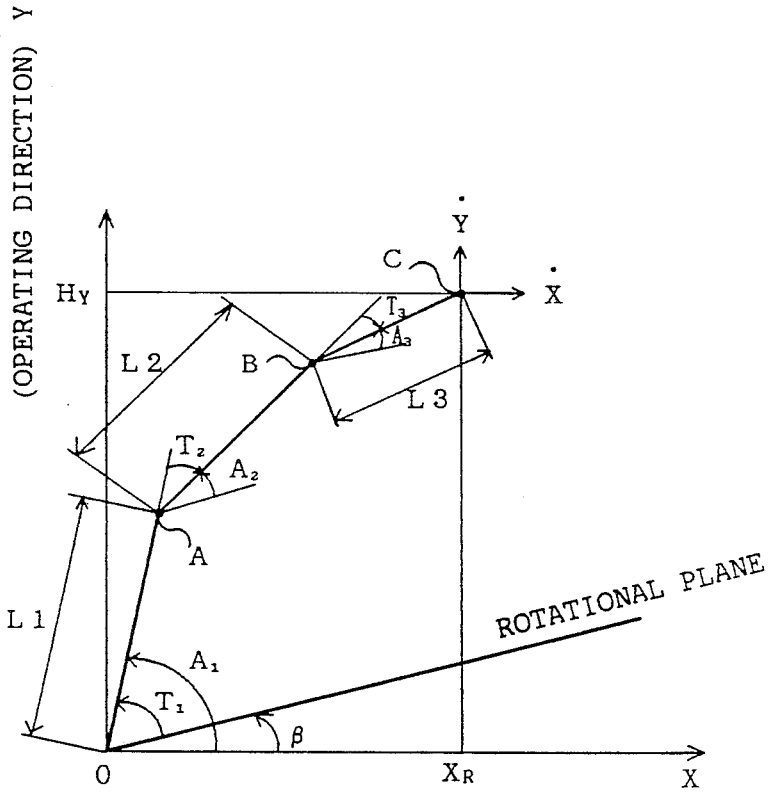

FIG. 19 illustrates a coordinate system of the industrial vehicle used in the fourth embodiment. The following description will be based on this coordinate system. In FIG. 19, the same portions as those shown in FIG. 1 are denoted by the same reference numerals, and only points of difference therebetween will be described.

In FIG. 19, X-axis, $\beta$ and $T_1$ are defined as follows:

X-axis: straight line which lies in a plane including the points O, A, B, and C and which is a line of intersection formed by that plane and a horizontal plane passing through the point O $\beta$: angle formed by the rotational plane of the revolving super structure US (FIG. 9A) with respect to the ground $T_1$: angle formed by the segment OA with respect to the rotational plane (the angle of the No. 1 arm 1 relative to the revolving super structure US)

where $$A_1 = T_1 + \beta$$
$$A_2 = A_1 - T_2$$

$$\begin{aligned} A_3 &= A_2 - T_3 \\ &= A_1 - T_2 - T_3 \end{aligned}$$

$X_R$: X-coordinate at point C $H_Y$: Y-coordinate at point C (First and Second Systems of Arm Movement)

A description will now be given of two different methods of controlling the arm movement in accordance with this embodiment.

In this embodiment, one control lever for the locus control is provided, and the tip C of the No. 3 arm 3 is adapted to move along the targeted locus orientated in the direction of gravity by the operation of this control lever. In addition, the following two systems are established: (1) a first system in which the No. 1 arm 1 is fixed and the No. 2 and No. 3 arms 2, 3 are driven to move the tip of the No. 3 arm along the targeted locus, in the same way as the above-described first embodiment; (2) a second system in which all the No. 1 to No. 3 arms are driven to move the same. The locus control is performed by either of the control systems (1) and (2) in correspondence with the posture of the industrial vehicle.

(1) First System of Arm Movement

As described below, the angular velocities $\dot{T}_2$, $\dot{T}_3$ of the No. 2 and No. 3 arms 2, 3 can be expressed from the above-described Formulae (8) and (9) by using the command values $\dot{X}$ and $\dot{Y}$ for the velocity in the X- and Y-directions.

$$\dot{T}_2 = \frac{\dot{X} \cdot \cos A_3 + \dot{Y} \cdot \sin A_3}{L_2 \cdot \sin T_3} \quad (8)$$

$$\dot{T}_3 = -\frac{1}{L_2 \cdot L_3 \cdot \sin T_3} \{\dot{X}(L_2 \cdot \cos A_2 + L_3 \cos A_3) + Y\{L_2 \cdot \sin A_2 + L_3 \cdot \sin A_3)\} \quad (9)$$

where $\dot{Y}$ is the command value for the velocity in the operating direction, which is input by the aforementioned locus control lever. In the first locus controlling system, X is defined as a first command value $\dot{X}_1$ for the velocity in the compensating direction, which is expressed by the following formula:

$$\dot{X}_1 - K_2(X_O - X_R) \cdot |\dot{Y}| \quad (20)$$

where $K_2$ is a constant; $X_O$ is a targeted operating range; and $X_R$ is expressed by $$X_R = L_1 \cdot \cos A_1 + L_2 \cdot \cos A_2 + L_3 \cdot \cos A_3 \quad (21)$$

In other words, $(X_O - X_R)$ is a deviation between the distance $X_O$ in the X-direction from the origin O to the tip C of the No. 3 arm 3 at the start of operation of the locus control lever and the distance $X_R$ in the X-direction which is consecutively determined by Formula (21) after the operation start. Accordingly, this first command value $\dot{X}_1$ for the velocity in the compensating direction is a velocity command value which is proportional to both the deviation $X_O - X_R$ and an absolute value $|\dot{Y}|$ of the command value $\dot{Y}$ for the velocity in the Y-direction which is input by the operation of the control lever.

As can be seen from the above, in this first locus controlling system, when the No. 1 arm 1 is fixed and the No. 2 and No. 3 arms 2, 3 are driven by the locus control lever, an amount of deviation of the tip of the No. 3 arm 3 in the X-direction is fed back, and this system is therefore basically the same as the controlling system of the first embodiment.

(2) Second System of Arm Movement

In this system, the operating velocity is obtained by controlling the No. 1 arm 1, and the No. 2 and No. 3 arms 2, 3 are controlled in such a manner as to offset the deviation of the tip of the No. 3 arm 3 from the targeted locus in the X-direction occurring as a result of rotation of the No. 1 arm 1. At the same time, the deviation of the same is constantly fed back for the control of the No. 2 and No. 3 arms 2, 3.

The basic principle of this system will be described hereafter.

Figure 20:
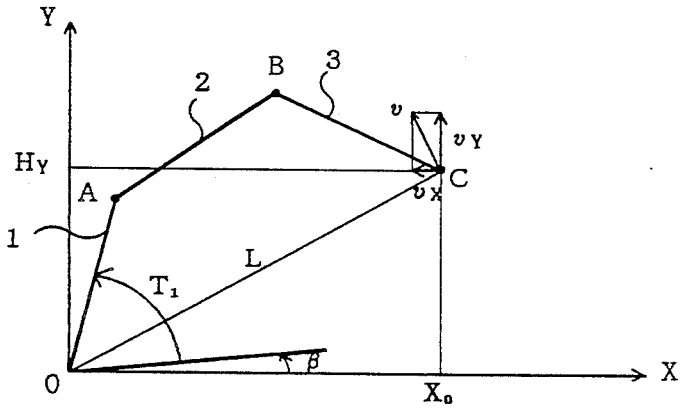

In FIG. 20, if, when only the No. 1 arm 1 is driven at the angular velocity $T_1$ with the No. 2 and No. 3 arms 2, 3 fixed, it is assumed that the length of the segment OC connecting the origin 0 and the tip C of the No. 3 arm 3 is L and that the tangential velocity thereof is v, we have $$v = L \cdot \dot{T}_1 \quad (22)$$

Component in the operating direction $v_Y$ is expressed as follows:

$$v_Y = v \cdot \frac{X_0}{L} = X_O \cdot \dot{T}_1 \quad (23)$$

Component in the compensating direction $v_X$ is expressed as follows:

$$v_X = -v \cdot \frac{H_Y}{L} = -H_Y \cdot \dot{T}_1 \quad (24)$$

where $H_Y$ is the height in the operating direction with the origin O of the point C of the tip of the No. 3 arm 3 as the reference.

Now, if the operating velocity command value in accordance with the second locus controlling system is assumed to be $\dot{Y}_1$, since $v_Y = \dot{Y}_1$, the angular velocity $\dot{T}_1$ of the No. 1 arm 1 can be expressed from Formula (23) as $$\dot{T}_1 = \frac{\dot{Y}_1}{X_0} \quad (25)$$

Namely, in the second locus controlling system, the No. 1 arm 1 is controlled at the angular velocity determined from Formula (25) with respect to the given operating velocity command value $\dot{Y}_1$.

In addition, the angular velocities $\dot{T}_2$, $\dot{T}_3$ of the No. 2 and No. 3 arms 2, 3 are determined as follows: If the compensating velocity command value for canceling $v_X$ occurring as a result of the rotation of the No. 1 arm 1 is defined as a second command value $\dot{X}_2$ for the velocity in the compensating direction, this $\dot{X}_2$ can be expressed as $$X_2 = -v_X = H_Y \cdot \dot{T}_1 = H_Y \cdot \frac{\dot{Y}_1}{X_0} \quad (26)$$

Therefore, if a sum of Formulae (20) and (26), i.e., $$\dot{X} = K_2(X_O - \dot{X}_R) \cdot |Y| + H_Y \frac{\dot{Y}}{X_0} \quad (27)$$

is used as $\dot{X}$ in the above-described Formulae (8) and (9), the above-mentioned deviation resulting from the rotation of the No. 1 arm 1 can be canceled by controlling the No. 2 and No. 3 arms 2, 3 simultaneously as the feedback of the deviation in accordance with the first locus controlling system.

Thus, in this fourth embodiment, these first and second locus controlling systems are automatically selected in correspondence with the angle of the No. 1 arm 1 and the operating height of the tip of the No. 3 arm 3. A detailed description will be given hereafter of this selective changeover.

Figure 21:
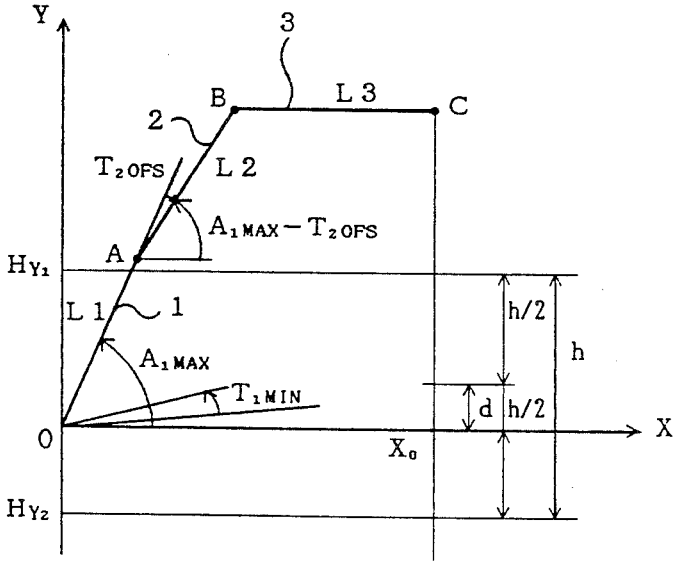

First, as shown in FIG. 21, the angle of the No. 1 arm 1 is classified into the three ranges: a minimum angle less than $T_{1MIN}$, a maximum angle $A_{1MAX}$ or more, and an intermediate range between the minimum angle $T_{1MIN}$ and the maximum angle $T_{1MAX}$. Here, the minimum angle $T_{1MIN}$ is an angle in which some leeway is allowed in the minimum value of the angle $T_1$ when the cylinder 4 for the No. 1 arm 1 has shrunk most, i.e., the angle $T_1$ being formed between the No. 1 arm 1 and the rotational plane. Meanwhile, the maximum angle $A_{1MAX}$ is a minimum angle of the No. 1 arm which allows the No. 2 arm 2 to be made controllable, i.e., permits the tip of the No. 3 arm to move along the targeted locus elongated in the operating direction without the No. 2 arm cylinder 5 coming to a stroke end, or it is the angle of the No. 1 arm which takes a value greater than that value. To give a more detailed description, if it is assumed that the predetermined targeted operating radius $X_O$ is given, when the angle $A_1$ of the No. 1 arm is below $A_{1MAX}$ or below shown in FIG. 21, the No. 2 arm cylinder 5 comes to the stroke end before the No. 3 arm angle $A_3$ reaches zero degree, thereby making it impossible to move the tip of the No. 3 arm along the targeted locus continuously. Then, the angle of the No. 2 arm 2 with respect to the No. 1 arm 1 immediately before the No. 2 arm cylinder 5 comes to the stroke end is assumed to be $T_{2OFS}$. If the targeted operating radius $X_O$ has been given and $A_{1MAX}$ is determined in such a manner as to satisfy $$X_O = L_1 \cdot \cos(A_{1MAX}) + L_2 \cos(A_{1MAX} - T_{2OFS}) + L_3 \quad (28)$$

it is possible to perform the locus control of the tip of the No. 3 arm 3 without the No. 2 arm cylinder 5 coming to the stroke end in case the angle $A_1$ of the No. 1 arm is in the range of $A_{1MAX}$ or more.

Here, if Formula (28) is determined for $A_{1MAX}$, since $T_{2OFS}$, $L_1$, $L_2$, and $L_3$ are constants, we have $$A_{1MAX} = G_1(X_O) \quad (29)$$

and this maximum angle $A_{1MAX}$ can be determined by the targeted operating radius $X_O$ alone.

Next, the height $H_Y$ of the tip of the No. 3 arm 3 is classified into three ranges by means of $H_{Y1}$ and $H_{Y2}$, as shown in FIG. 21. Here, $$H_{Y1} = d + \frac{h}{2} \quad (30)$$

$$H_{Y2} = d - \frac{h}{2} \quad (31)$$

where d is the height of an intermediate point between the maximum operating height at the targeted operating radius $X_O$ when the angle $A_1$ of the No. 1 arm set as $A_{1MAX}$ on the one hand, and the minimum operating height at the targeted radius $X_O$ when the angle $T_1$ of the No. 1 arm 1 with respect to the rotational plane is set as $T_{1MIN}$; and h is the distance of movement of the tip of the No. 3 arm 3 as the No. 1 arm 1 rotates from the angle $T_{1MIN}$ to the angle $A_{1MAX}$ at the angular velocity $\dot{T}_1$ when the tip of the No. 3 arm 3 is controlled to move along the targeted locus passing through the point of which X-coordinate is $X_O$ in accordance with the second locus controlling method. In other words, if the time when the No. 1 arm 1 rotates from the angle $T_{1MIN}$ to the angle $A_{1MAX}$ is assumed to be t, we have $$t = (A_{1MAX} - T_{1MIN}) / \dot{T}_1 \quad (32)$$

$$\begin{aligned} h &= \dot{Y}t \\ &= (A_{1MAX} - T_{1MIN})\, \dot{Y} / \dot{T}_1 \end{aligned} \quad (33)$$

Hence, from Formulae (25) and (33), the distance h of movement of the tip of the No. 3 arm is expressed as $$h = (A_{1MAX} - T_{1MIN}) X_O \quad (34)$$

The angle $A_{1MAX}$ is determined univocally by the targeted operating radius $X_O$ on the basis of Formula (29), while, since $T_{1MIN}$ is a fixed value, both the distances d and h are determined by the targeted operating radius $X_O$. Accordingly, a maximum operating height $H_{Y1}$ and a minimum operating height $H_{Y2}$ can be expressed as $$H_{Y1} = G_2(X_O) \quad (35)$$

$$H_{Y2} = G_3(X_O) \quad (36)$$

Incidentally, as for $H_{Y1}$ and $H_{Y2}$, insofar as the region defined between these heights includes an operating height zero which is a region facilitating compensation of the deviation in the X-direction when the tip of the No. 3 arm 3 moves between them, $H_{Y1}$ and $H_{Y2}$ may be determined by another method.

The first and second locus controlling systems are selected with respect to a combination of the ranges of the angle of the No. 1 arm and the ranges of the operating height, as shown in FIG. 22.

Namely, in the controlling direction of $\dot{Y} > 0$ (rising), the second locus controlling system is selected when the angle of the No. 1 arm is less than $A_{1MAX}$ and the operating height is $H_{Y2}$ or more, and the first locus controlling system is selected in the other cases.

In addition, in the controlling direction of $\dot{Y} < 0$ (lowering), the second locus controlling system is selected when the angle of the No. 1 arm is $T_{1MIN}$ or more and the operating height is less than $H_{Y1}$, and the first locus controlling system is selected in the other cases.

In these locus controlling systems, the angle of the No. 1 arm is controlled in such a manner as to reciprocate between $A_{1MAX}$ and $T_{1MIN}$. Therefore, if the locus controlling systems are selected as shown in FIG. 22, the angle of the No. 1 arm at the start of control can be set to a desired angle.

Figure 23A:
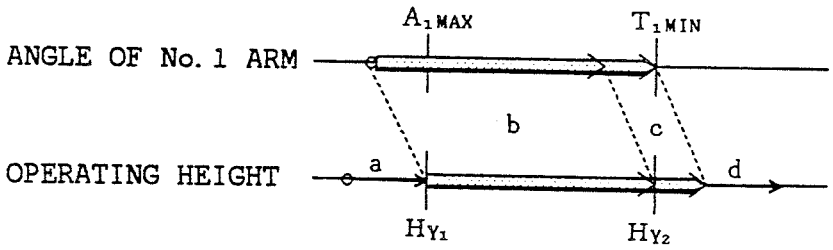
FIGS. 23A to 23C are diagrams illustrating how the control of the arm movement is changed over in accordance with a combination of the angle of the No. 1 arm and the operating height.

For instance, it is assumed that the control is commenced in the direction of $\dot{Y} < 0$ and the operating height is $H_{Y1}$ or more. If the angle of the No. 1 arm is $A_{1MAX}$ or more at the start of control, the locus control is effected in the following order of (a) to (d), as shown in FIG. 23A.

(a) First locus controlling system: The angle of the No. 1 arm is fixed, and the operating height is brought to $H_{Y1}$.

(b) Second locus controlling system: The angle of the No. 1 arm is brought to $T_{1MIN}$, and the operating height to $H_{Y2}$.

(c) Second locus controlling system: The angle of the No. 1 arm is brought to $T_{1MIN}$, and the operating height to less than $H_{Y2}$.

(d) First locus controlling system: The angle of the No. 1 arm is fixed, and the operating height is brought further to less than $H_{Y2}$.

Figure 23B:
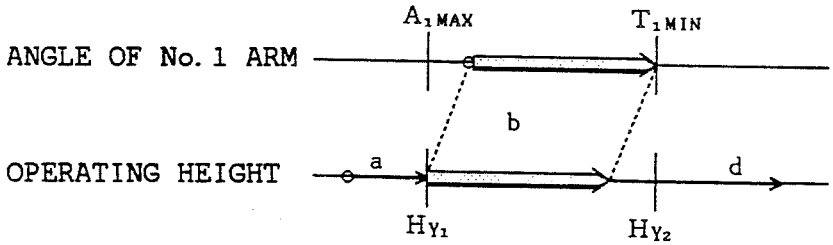

Similarly, when the angle of the No. 1 arm is between $A_{1MAX}$ and $T_{1MIN}$, the locus control is effected in the order of (a), (b) and (d) shown in FIG. 23B. Incidentally, the steps (a), (b), and (d) are the same as the aforementioned steps (a), (b), and (d), so that a description thereof will be omitted.

Figure 23C:
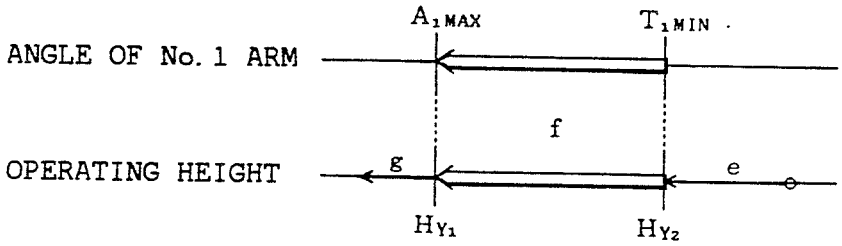

When control is commenced in the direction of $\dot{Y}>0$, the locus control is effected in the following order of (e) to (g), as shown in FIG. 23C:

(e) First locus controlling system: The angle of the No. 1 arm is fixed, and the operating height is brought to $H_{Y2}$.

(f) Second locus controlling system: The angle of the No. 1 arm is brought to $A_{1MAX}$, and the operating height to $H_{Y1}$.

(g) First locus controlling system: The angle of the No. 1 arm is fixed, and the operating height is brought to $H_{Y1}$ or more.

Subsequently, the angle of the No. 1 arm constantly reciprocates between $A_{1MAX}$ and $T_{1MIN}$.

It should be noted that even if the operating height of the tip of the No. 3 arm at the start of control is set to a level other than those described above, the first and second systems are similarly selected appropriately.

(Configuration of the Apparatus of the Fourth Embodiment)

Referring now to FIGS. 24 to 30, a description will be given of the configuration of the arm movement controlling apparatus in accordance with the fourth embodiment.

Figure 24:
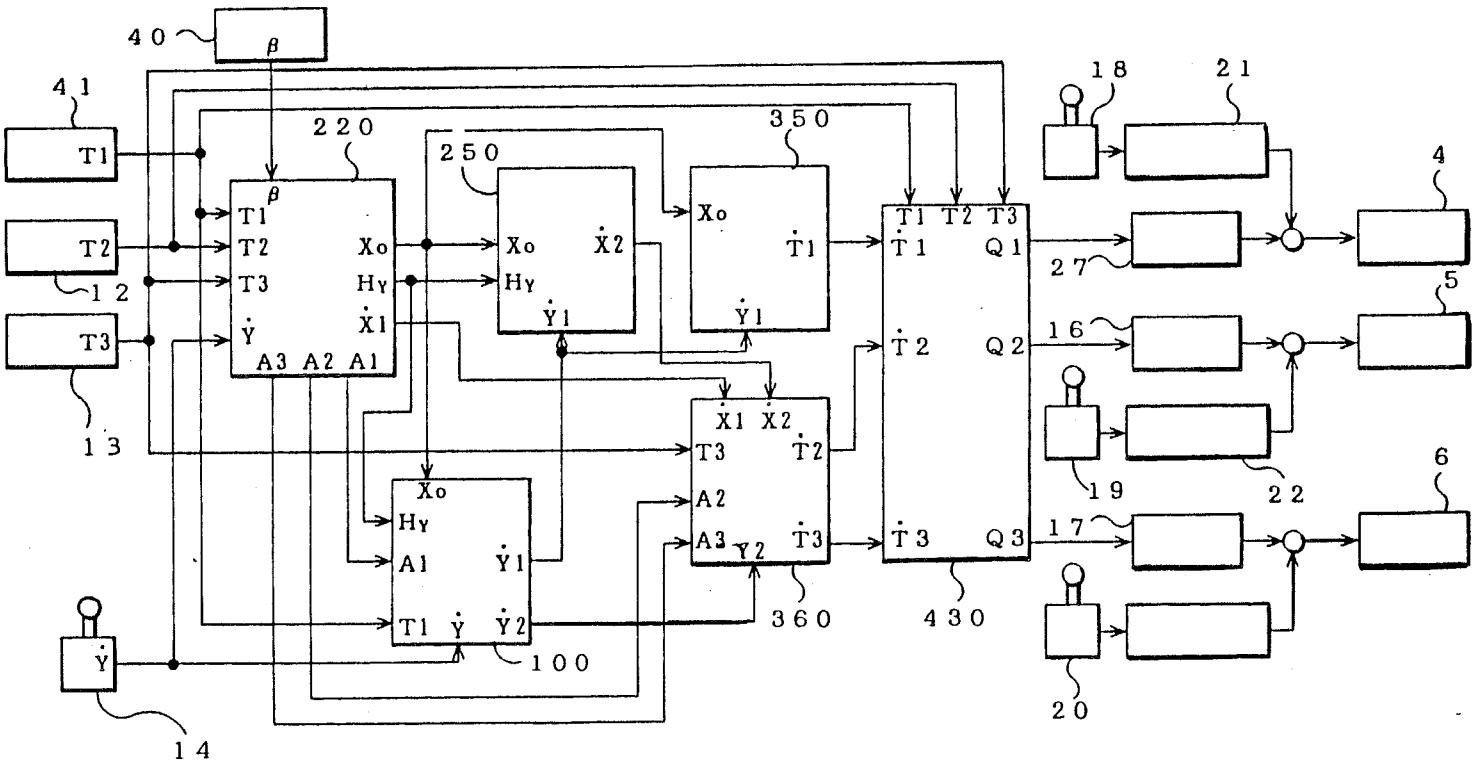

(1) Overall Configuration (FIG. 24)

In FIG. 24, an angle detector 40 installed on a frame of the revolving super structure detects the angle $\beta$ of inclination of the revolving super structure US (FIG. 9A) by means of known pendulum mechanism and potentiometer, and inputs the angle $\beta$ of inclination to a first circuit 220 for calculating a command value for the compensating velocity. An angle detector 41 mounted at a point of supporting the rotation of the No. 1 arm 1 detects the angle $T_1$ of the No. 1 arm 1 relative to the revolving super strucutre US, and inputs that relative angle $T_1$ to an arithmetic circuit 100 for dividing a command value for the operating velocity, the first circuit 220 for calculating the compensating velocity, and a circuit 430 for calculating a flow-rate control value. The angle detectors 12, 13 are respectively installed at the points of supporting the rotation of the No. 2 and No. 3 arms 2, 3, detect the relative angle $T_2$ between the No. 1 and No. 2 arms 1, 2 and the relative angle $T_3$ between the No. 2 and No. 3 arms 2, 3. The relative angles $T_2$, $T_3$ are input to the first circuit 220 for calculating the command value for the compensating velocity and the circuit 430 for calculating the flow-rate control value, respectively.

The control lever 14 installed in the operator's cabin is constituted by, for instance, known lever mechanism and potentiometer, and outputs a signal corresponding to the operating angle of the lever. The signal thus outputted is input to the arithmetic circuit 100 for dividing the command value for the operating velocity and the first circuit 220 for calculating the command value for the compensating velocity as the command value $\dot{Y}$ for the operating velocity of the tip of the No. 3 arm 3.

On the basis of the angles $A_1$, $T_1$, the operating height $H_Y$, and the targeted operating radius $X_O$, the arithmetic circuit 100 for dividing the command value for the operating velocity divides the operating velocity command value $\dot{Y}$ into a first operating velocity command value $\dot{Y}_1$ and a second operating velocity command value $\dot{Y}_2$. The operating command value $\dot{T}_1$ is connected to a second circuit 250 for calculating the compensating velocity and a second circuit 350 for calculating an angular velocity control value. The operating command value $\dot{Y}_2$ is connected to a first circuit 360 for calculating an angular velocity control value.

The first circuit 220 for calculating the command value for the compensating velocity calculates the first compensating velocity command value $\dot{X}_1$ on the basis of the angles $\beta$, $T_1$, $T_2$, $T_3$, and the operating velocity command value Y, and inputs the same to the first circuit 360 for calculating the angular velocity control value. Also, the circuit 220 calculates the distance $X_O$ in the X-direction (referred to as the targeted operating radius) from the origin O to the tip of the No. 3 arm 3 at the start of operation of the locus control lever 14, the angles $A_1$, $A_2$, and $A_3$ formed by the respective No. 1, No. 2, and No. 3 arms 1, 2, 3 with respect to the X-axis, and the distance $H_Y$ in the Y-direction (operating height) from the origin O to the tip of the No. 3 arm 3. $A_1$, $H_Y$, and $X_O$ are input to the arithmetic circuit 100 for dividing the command value for the operating velocity, while the angles $A_2$, $A_3$ are also input to the first circuit 360 for calculating the angular velocity control value.

The second circuit 250 for calculating the command value for the compensating velocity calculates the second compensating velocity command value $\dot{X}_2$ on the basis of the distance $X_O$, the operating height $H_Y$, and the first operating velocity command value $Y_1$, and inputs the same to the first circuit 360 for calculating the angular velocity control value.

The first circuit 360 for calculating the angular velocity control value calculates the angular velocity control values $\dot{T}_2$, $\dot{T}_3$ for the No. 2 and No. 3 arms 2, 3 on the basis of the angles $A_2$, $A_3$, $T_3$ and the velocity command values $\dot{X}_1$, $\dot{X}_2$, $\dot{Y}$, and inputs the same to the circuit 430 for calculating the flow-rate control value, respectively.

The second circuit 350 for calculating the angular velocity control value calculates the angular velocity control value $\dot{T}_1$ for the No. 1 arm 1 on the basis of the radious $X_O$ and the first operating velocity command value $\dot{Y}_1$, and inputs the same to the circuit 430 for calculating the flow-rate control value.

The circuit 430 for calculating the flow-rate control value calculates the flow-rate control values $Q_1$, $Q_2$, $Q_3$ for the cylinders 4, 5, 6 on the basis of the angular velocity control values $\dot{T}_1$, $\dot{T}_2$, $\dot{T}_3$ and the angles $T_1$, $T_2$, $T_3$, and inputs the same to the electro-hydraulic control valves 27, 16, 17, respectively. Pressure oil is introduced into these electro-hydraulic control valves 27, 16, 17 from a hydraulic source, and these electro-hydraulic control valves 27, 16, 17 supply pressure oil to the cylinders 4, 5, 6 for the No. 1, No. 2, and No. 3 arms 1, 2, 3 at flow rates and in directions corresponding to the input flow-rate control values $Q_1$, $Q_2$, $Q_3$, respectively.

Pilot hydraulic pressure is produced corresponding to an amount of manual operation of the operation levers 18 to 20 to be supplied to the control valves 21 to 23. As a result, the areas of opening of the control valves 21 to 23 and changing-over directions thereof are controlled. The control valves 21 to 23 control the flow rates and directions of pressure oil supplied to the cylinders 4 to 6 by means of the pilot hydraulic pressure from the operating levers 18 to 20. The cylinders 4 to 6 are capable of undergoing a telescopic operation arbitrarily by means of the operating levers 18 to 20 and are connected to the respective valves so that they can be subjected to the telescopic operation by the pressure oil from the control valves 21, 22, 23 or the electro-hydraulic control valves 27, 16, 17.

(2) Detailed Description of Each Circuit

Figure 25:
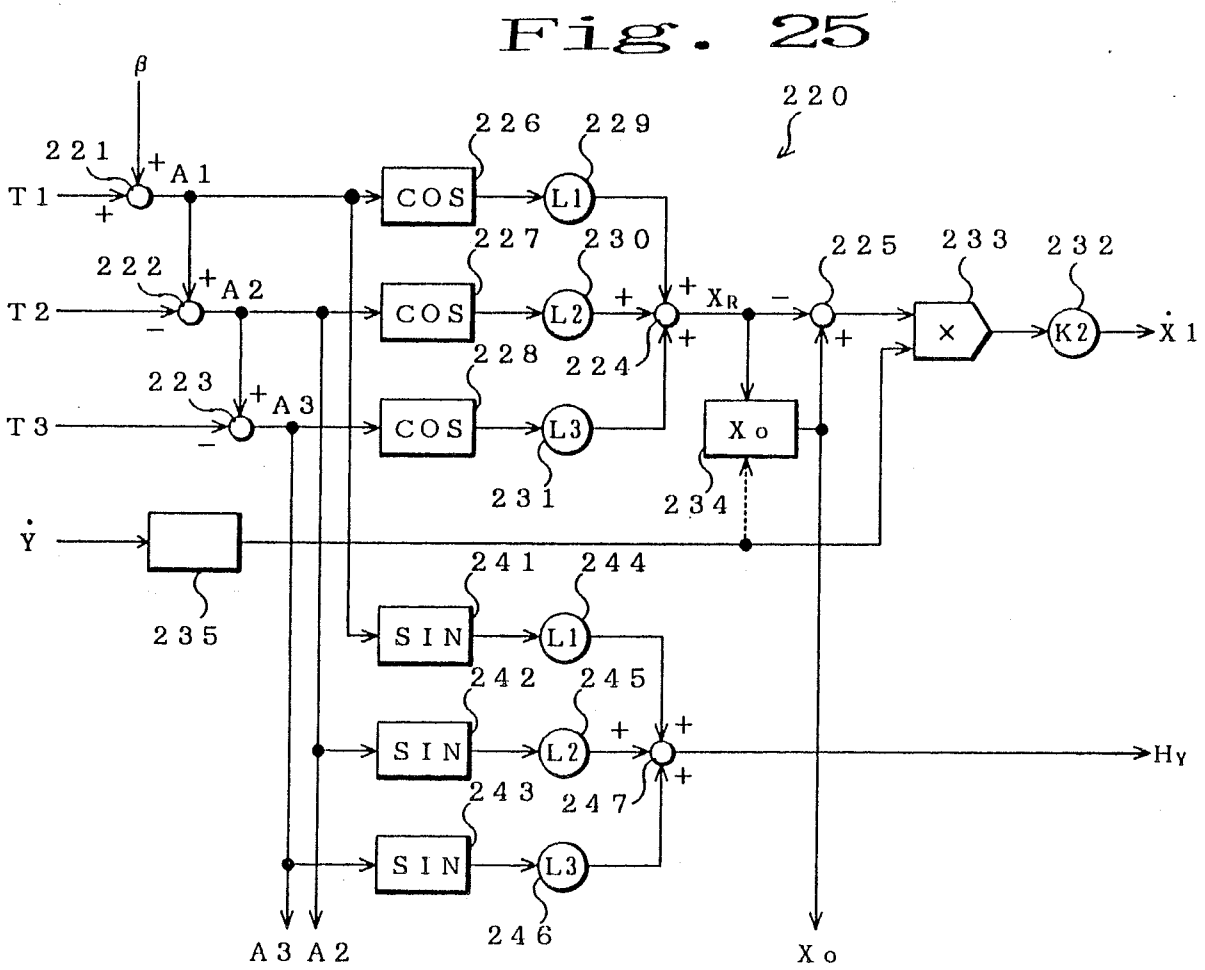

FIG. 25 illustrates the first circuit 220 for calculating the command value for the compensating velocity to which the angles $T_1$, $T_2$, $T_3$, $\beta$, and the operating velocity command value $\dot{Y}$ are input and which calculates the targeted operating radius $X_O$, the distance in the Y-direction (the operating height) from the origin O to the tip of the No. 3 arm 3, and the first compensating velocity command value $\dot{X}_1$.

As shown in FIG. 25, the distance $X_R$ in the X-direction shown in Formula (21) is determined by the following: an adder 221 for outputting the angle $A_1$ which indicates a sum $(\beta+T_1)$ of the angles $\beta$ and $T_1$; a deviation device 222 for outputting the angle $A_2$ which indicates a diviation $(A_1-T_2)$ between the angles $A_1$ and $T_2$; a deviation device 223 for outputting the angle $A_3$ which indicates a diviation $(A_2-T_3)$ between the angles $A_2$ and $T_3$; function generators 226 to 228 for respectively outputting cos $A_1$ to cos $A_3$; coefficient devices 229 to 231 for outputting $L_1 \cdot \cos A_1$ to $L_3 \cdot \cos A_3$ by multiplying these output values by coefficients $L_1$ to $L_3$; and an adder 224 for outputting the distance $X_R$ in the X-direction by adding $L_1 \cdot \cos A_1$ to $L_3 \cdot \cos A_3$ together.

At the start of operation of the control lever 14, the distance $X_R$ in the X-direction thus determined is stored in a memory 234 as the initial value $X_O$, and a deviation $(=X_O-X_R)$ between the output $X_R$ from the adder 224 and the output $X_O$ from the memory 234 is obtained by a deviation device 225. In addition, the calculation of the first compensating velocity command value $\dot{X}_1$ shown in Formula (20) is performed by a multiplier 233 which multiplies the deviation $(X_O-X_R)$ and the absolute value $|\dot{Y}|$ of the operating velocity command value $\dot{Y}$ obtained from an absolute value converter 235; and a coefficient device 232 which multiplies the output $|\dot{Y}|(X_O-X_R)$ by the coefficient $K_2$.

Meanwhile, the operating height $H_Y$ is expressed by $$H_Y=L_1 \cdot \sin A_1+L_2 \cdot \sin A_2+L_3 \cdot \sin A_3 \quad (37)$$

and, as shown in FIG. 25, is determined by the following: function generators 241 to 243 for outputting sin $A_1$ to sin $A_3$; coefficient devices 244 to 246 for outputting $L_1 \cdot \sin A_1$ to $L_3 \cdot \sin A_3$ by multiplying these outputs by the coefficients $L_1$ to $L_3$; and an adder 247 for outputting the distance $H_Y$ in the Y-direction by adding $L_1 \cdot \sin A_1$ to $L_3 \cdot \sin A_3$ together.

Figure 26:
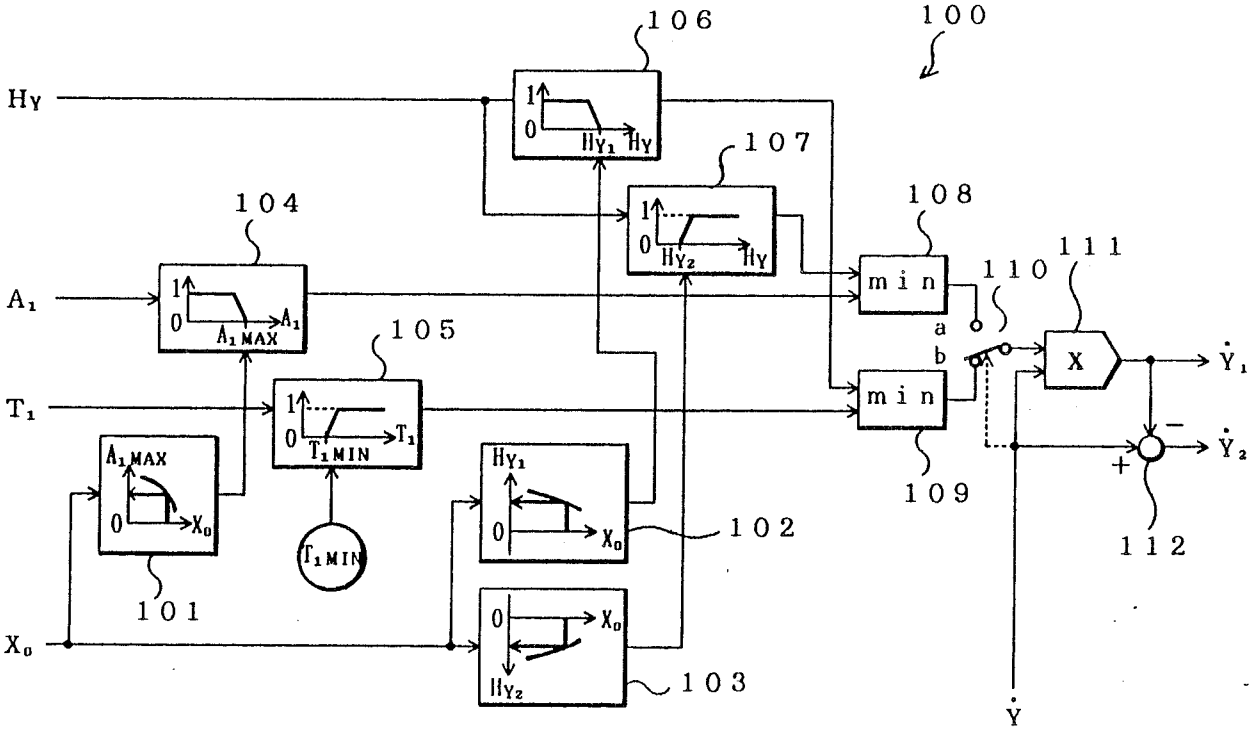

FIG. 26 shows the arithmetic circuit 100 for dividing the command value for the operating velocity to which the angles $A_1$, $T_1$, the targeted operating radius $X_O$, and the distance $H_Y$ in the Y-direction are input and calculates the first and second operating velocity command values $\dot{Y}_1$, $\dot{Y}_2$ on the basis of the operating velocity command value $\dot{Y}$.

Here, as shown in Table 1, when the first operating velocity command value $\dot{Y}_1$ is zero and the second operating velocity command value $\dot{Y}_2$ is equal to the operating velocity command value $\dot{Y}$, the first locus controlling system is selected, while, when the first operating velocity command value $\dot{Y}_1$ is equal to the operating velocity command value $\dot{Y}$ and the second operating velocity command value $\dot{Y}_2$ is zero, the second locus controlling system is selected.

TABLE 1

| Locus Controlling System | $\dot{Y}_1$ | $\dot{Y}_2$ |
|---|---|---|
| First system | O | $\dot{Y}$ |
| Second system | $\dot{Y}$ | O |

The arithmetic circuit 100 for dividing the command value for the operating velocity is provided with some circuits described below so that the selection of the first and second controlling systems described above is effected in accordance with the conditions of FIG. 22. Namely, these circuits include a function generator 101 for outputting the angle $A_{1MAX}$ from the input targeted operating radius $X_O$ and function generators 102, 103 for respectively outputting the maximum operating height $H_{Y1}$ and the minimum height $H_{Y2}$ from $X_O$ in a similar manner. The function generator 101 satisfies Formula (29) and the function generators 102, 103 satisfy Formulae (35), (36), respectively.

Furthermore, the arithmetic circuit 100 for dividing the command value for the operating velocity constitutes a logical circuit for selecting the locus controlling systems with respect to a combination of the ranges of the angle of the No. 1 arm and the operating height. Therefore, it is provided with function generators 104 to 107. The function generator 104 outputs 0 when the angle $A_1$ is $A_{1MAX}$ or more and 1 when it is less than $A_{1MAX}$; the function generator 105 outputs 0 when the angle $T_1$ is less than $T_{1MIN}$ and 1 when it is $T_{1MIN}$ or more; the function generator 106 outputs 0 when the operating height $H_Y$ is $H_{Y1}$ or more and 1 when it is less than $H_{Y1}$; and the function generator 107 outputs 0 when the operating height $H_Y$ is less than $H_{Y2}$ and 1 when it is $H_{Y2}$ or more. However, in each of the function generators, in order to effect the changeover of control without any shock, the so-called linear control is carried out so that the output is changed progressively from 0 to 1 or vice versa.

In addition, a minimum value selection circuit 108 selects a minimum value from a signal output from the function generator 104 in response to $A_{1MAX}$ and a signal output from the function generator 107 in response to the minimum operating height $H_{Y2}$. A minimum value selection circuit 109 selects a minimum value from a signal output from the function generator 105 in response to $T_{1MIN}$ and a signal output from the function generator 106 in response to the maximum operating height $H_{Y1}$. A switching device 110 is changed over in reponse to the positive or negative value of the operating velocity command value $\dot{Y}$, and a contact a is closed when the value is positive, and a contact b is closed when it is negative.

A multiplier 111 multiplies the signal output from the minimum value selection circuit 108 or 109 by the operating velocity command value $\dot{Y}$. The multiplier 111 outputs 0 when the output of the minimum value selection circuit 108 or 109 input thereto is 0, while the multiplier 111 outputs the operating velocity command value $\dot{Y}$ when the output of the minimum value selection circuit 108 or 109 input thereto is 1. This output of the multiplier 111 is used as the first operating velocity command value $\dot{Y}_1$. A deviation device 112 calculates a deviation between the output of the multiplier 111 and the operating velocity command value Y so as to obtain the second operating velocity command value $\dot{Y}_2$. When the multiplier 111 outputs 0, the second operating velocity command value $\dot{Y}_2$ becomes equal to the operating velocity command value $\dot{Y}$, and when it outputs $\dot{Y}$, the second operating velocity command value $\dot{Y}_2$ becomes 0. Namely, the second operating velocity command value $\dot{Y}_2$ is determined by the deviation device 112 from $$\dot{Y}_2 = \dot{Y} - \dot{Y}_1$$

If the case is considered with respect to the conditions of selecting the second locus controlling method, since the control direction of $\dot{Y} > 0$ (rising) causes the switching device 110 to be changed over to the contact a side, the minimum value selection circuit 108 selects a minimum value 1 between the output of the function generator 104 which outputs 1 when the angle $A_1$ of the No. 1 arm is less than $A_{1MAX}$ on the one hand, and the output of the function generator 107 which outputs 1 when the operating height $H_Y$ is $H_{Y2}$ or more on the other. If this minimum value 1 is multiplied by the operating velocity command value $\dot{Y}$ by means of the multiplier 111, the command value of the second locus controlling system, i.e., the first operating velocity command value $\dot{Y}_1$ equivalent to the operating velocity command value Y, can be obtained. At this juncture, the second operating velocity command value $\dot{Y}_2$ becomes zero. Similarly, since the control direction of $\dot{Y} < 0$ (lowering) causes the switching device 110 to be changed over to the contact b side, the minimum value selection circuit 109 selects the minimum value 1 between the output of the function generator 105 which outputs 1 when the angle $T_1$ of the No. 1 arm is $T_{1MIN}$ or more on the one hand, and the output of the function generator 106 which outputs 1 when the operating height $H_Y$ is less than $H_{Y1}$ on the other. Thus, the first operating velocity command value $\dot{Y}_1$ which is equivalent to the operating velocity command value $\dot{Y}$ can be obtained as in the case of the rising case. At this juncture as well, the second operating velocity command value $Y_2$ becomes zero. In all the other combinations of the angle of the No. 1 arm and the operating height, to ensure that the first locus controlling system will be adopted, the first operating velocity command value $\dot{Y}_1$ becomes zero, and the second operating velocity command value $\dot{Y}_2$ becomes equivalent to the operating velocity command value $\dot{Y}$.

Figure 27:
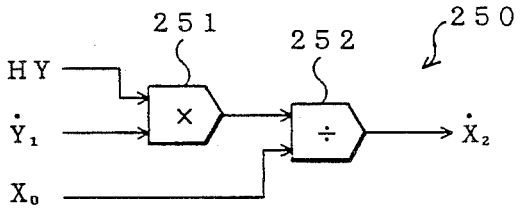

FIG. 27 shows the second circuit 250 for calculating the command value for the compensating velocity to which the first operating velocity command value $\dot{Y}_1$, the targeted operating radius $X_O$, and the operating height $H_Y$ are input and which calculates the second compensating velocity command value $\dot{X}_2$.

Through multiplying the first operating velocity command value $\dot{Y}_1$ by the operating height $H_Y$ by means of a multiplier 251 in accordance with Formula (26), and dividing the product by the targeted operating radius $X_O$ by means of a divider 252, the second compensating velocity command value $\dot{X}_2$ can be determined.

Figure 28:
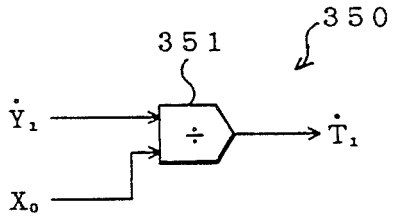

FIG. 28 shows the second circuit 350 for calculating the angular velocity control value to which the first operating velocity command value $\dot{Y}_1$ and the targeted operating radius $X_O$ are input and which calculates the angular velocity control value $T_1$ for the No. 1 arm 1.

The angular velocity control value $\dot{T}_1$ for the No. 1 arm 1 can be determined from Formula (25) through dividing the first operating velocity command value $\dot{Y}_1$ by the targeted operating radius $X_O$ by means of a divider 351.

Figure 29:
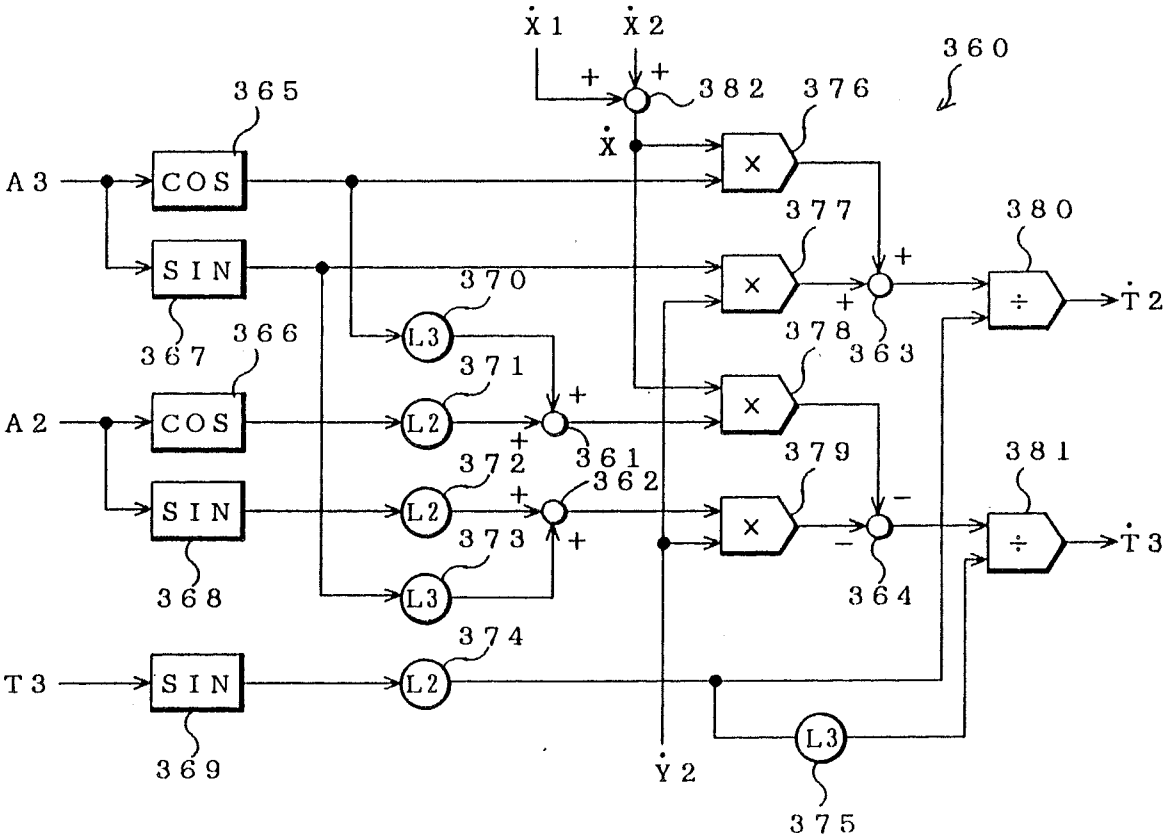

FIG. 29 shows the first circuit for calculating the angular velocity control value 360 to which the angles $A_2$, $A_3$, $T_3$, the second operating velocity command value $\dot{Y}_2$, and the compensating velocity command values $\dot{X}_1$, $\dot{X}_2$ are input and which calculates angular velocity control values $T_2$ and $T_3$ for the No. 2 and No. 3 arms 2, 3 with respect to the No. 1 and 2 arms 1, 2, respectively.

As shown in FIG. 29, the first circuit 360 for calculating the angular velocity control value comprises: function generators 365 to 369 for respectively outputting $\cos A_3$, $\sin A_3$, $\cos A_2$, $\sin A_2$, $\sin T_3$; coefficient devices 370 to 374 for multiplying these functions by a coefficient $L_2$ or $L_3$; a coefficient device 375 for muliplying $L_2 \cdot \sin T_3$ by the coefficient $L_3$; multipliers 376 to 379 for respectively outputting $\dot{X} \cos A_3$, $\dot{Y}_2 \cdot \sin A_3$, $\dot{X}(L_3 \cos A_3 + L_2 \cos A_2)$, and $\dot{Y}_2 (L_3 \sin A_3 + L_2 \sin A_2)$; adders 361, 362 for respectively outputting $L_3 \cdot \cos A_3 + L_2 \cdot \cos A_2$, $L_3 \cdot \sin A_3 + L_2 \cdot A_2$; adders 363, 364 for respectively outputting $(\dot{X} \cdot \cos A_3 + \dot{Y}_2 \cdot \sin A_3)$, $-\dot{X}(L_2 \cdot \cos A_2 + L_3 \cdot \cos A_3) - \dot{Y}_2(L_2 \cdot \sin A_2 + L_3 \cdot \sin A_3)$; and dividers 380, 381 which, upon receiving these outputs, performs divisions shown in Formula (8), (9) and outputs the angular velocity control values $\dot{T}_2$, $\dot{T}_3$. Incidentally, the compensating velocity command value $\dot{X}$ is obtained by adding the first and second compensating velocity command values $\dot{X}_1$ and $\dot{X}_2$ by means of an adder 382.

Figure 30:
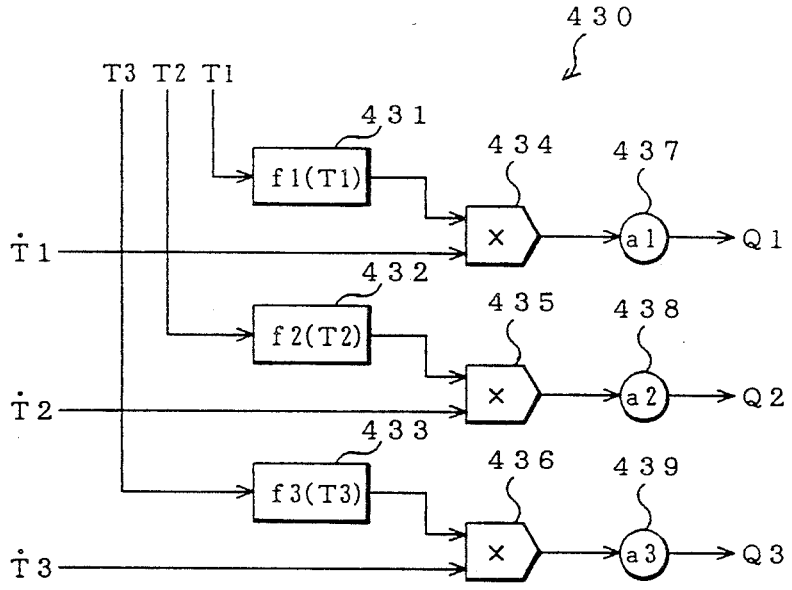

FIG. 30 shows the circuit 430 for calculating the flow-rate control value, to which the angles $T_1$, $T_2$, $T_3$ and angular velocity control values $\dot{T}_1$, $\dot{T}_2$, $\dot{T}_3$ are input and which calculates input signals $Q_1$, $Q_2$, $Q_3$ for the electro-hydraulic control valves 27, 16, 17.

As shown in Formula (12) in the first embodiment, if the link compensation coefficient is assumed to be f(T), the following formula holds between the cylinder velocity $\dot{S}$ and the angular velocity $\dot{T}$:

$$\dot{S} = f(T) \cdot \dot{T} \tag{12}$$

Since the necessary flow rate Q can be determined through multiplying the cylinder velocity $\dot{S}$ of Formula (12) by the cylinder area a, the flow-rate control values $Q_1$, $Q_2$, $Q_3$ for the first, second, and third cylinders 4, 5, 6 can be expressed as $$Q_1 = \dot{T}_1 \cdot f_1(T_1) \cdot a_1 \tag{38}$$

$$Q_2 = \dot{T}_2 \cdot f_2(T_2) \cdot a_2 \tag{39}$$

$$Q_3 = \dot{T}_3 \cdot f_3(T_3) \cdot a_3 \tag{40}$$

It should be noted that since the cylinder areas $a_1$, $a_2$, and $a_3$ in practice differs between the rod side and the bottom side, it is necessary to change over $a_1$, $a_2$, and $a_3$, as required, during extension and shrinkage of the cylinders 4, 5, 6.

As shown in FIG. 30, to calculate Formulae (38) to (40), this circuit 430 for calculating the flow-rate control value comprises: function generators 431 to 433 for generating functions $f_1(T_1)$, $f_2(T_2)$, and $f_3(T_3)$; multipliers 434 to 436 for calculating the cylinder velocity $\dot{S}$ shown in Formula (12); and coefficient devices 437 to 439 for obtaining the flow-rate control values $Q_1$, $Q_2$, and $Q_3$ by multiplying the cylinder velocity $\dot{S}$ by the cylinder areas $a_1$, $a_2$, and $a_3$.

A description will now be given of the operation of this apparatus.

When a power switch (not shown) is turned on, in the first circuit 220 for calculating the command value for the compensating velocity, the position of the tip of the No. 3 arm 3 in the compensating direction, i.e., an X-coordinate, is calculated on the basis of the angles $\beta$, $T_1$, $T_2$, and $T_3$ detected by the angle detectors 40, 41, 12, and 13. The X-coordinate at the point of starting the operation of the control lever 14 is stored in a memory 234 as the initial value (targeted operating radius) $X_O$. A line which passes through this $X_O$ and is parallel with the direction of the Y-axis (the operating direction and the direction of gravity) is the targeted locus OL (FIG. 4A), and the direction of the targeted locus is also the direction of gravity. Subsequently, an amount of deviation between the X-coordinate X of the tip of the No. 3 arm 3 and the initial value $X_O$ is calculated by the adder 225. At this time, the control lever 14 is outputting the operating velocity control value $\dot{Y}$ for the tip of the No. 3 arm 3 in the operating direction (the direction of the Y-axis). Upon receiving the operating velocity control value $\dot{Y}$, the first circuit 220 for calculating the compensating velocity command value outputs the first compensating velocity command value $\dot{X}_1$ by multiplying a product of this deviation and the absolute value $|\dot{Y}|$ of the operating velocity command value $\dot{Y}$ by the constant $K_2$. If the deviation is zero, the first compensating velocity command value $\dot{X}_1$ is zero.

The first circuit 220 for calculating the compensating velocity command value then calculates the angles $A_1$, $A_2$, $A_3$, and the position of the Y-coordinate of the tip of the No. 3 arm 3, i.e., the operating height $H_Y$. Meanwhile, the arithmetic circuit 100 for dividing the operating velocity command value divides the operating velocity command value $\dot{Y}$ into the first and second operating velocity command values $\dot{Y}_1$, $\dot{Y}_2$ on the basis of the operating posture, i.e., the angles $A_1$, $T_1$ of the No. 1 arm, the operating height $H_Y$, and the targeted operating radius $X_O$.

(1) Changeover from the first locus controlling system to the second locus controlling system during lowering of the arm For instance, when the angle $A_1$ of the No. 1 arm is $A_{1MAX}$ or more and the operating height $H_Y$ is $H_{Y1}$ or more determined by the targeted operating radius $X_O$, if the operating velocity command value $\dot{Y}$, is negative (i.e., for controlling in the lowering direction), an output 1 is delivered from the function generator 105, and an output 0 is delivered from the function generator 106, so that the output of the mimimum value selection circuit 109 becomes 0. Since the contact b of the switching device 110 is closed during $\dot{Y}<0$, the first operating velocity command value $\dot{Y}_1$ becomes zero, while the second operating velocity command value $\dot{Y}_2$ becomes equal to $\dot{Y}$.

For this reason, the angular velocity control value $\dot{T}_1$ for the No. 1 arm 1 output from the second circuit 350 for calculating the angular velocity control value becomes 0, while the second compensating velocity command value $\dot{X}_2$ output from the second circuit 250 for calculating the compensating velocity command value becomes zero. As a result, the first circuit 360 for calculating the angular velocity control value calculates the angular velocity contol values $\dot{T}_2$, $\dot{T}_3$ for the No. 2 and No. 3 arms 2, 3 in such a manner that the deviation described above will be compensated by the first compensating velocity command value $\dot{X}_1$ and the tip of the No. 3 arm will move at the operating velocity command value $\dot{Y}$. In consequence, the first locus controlling system is selected for effecting the locus control by fixing the No. 1 arm and by driving the No. 2 and No. 3 arms 2, 3.

Subsequently, when the height of the tip, which is being lowered in the Y-direction of the No. 3 arm 3, i.e., the operating height $H_Y$ reaches less than $H_{Y1}$, the output of the function generator 106 changes progressively from 0 to 1. Since the output of the function generator 105 remains 1, the output of the minimum value selection circuit 109 naturally changes progressively from 0 to 1. If this value is assumed to be k, the first and second operating velocity command values $\dot{Y}_1$, $\dot{Y}_2$ are given as $$\dot{Y}_1=k\cdot\dot{Y}$$

$$\dot{Y}_2=(1-k)\dot{Y}$$

When k becomes 1, $\dot{Y}$ becomes equivalent to $\dot{Y}$, and $\dot{Y}_2$ becomes zero.

Upon changing the output of the minimum value selection circuit 109 from 0 to 1, the angular velocity control value $\dot{T}_1$ for the No. 1 arm output from the second circuit 350 for calculating the angular velocity control value represents an angular velocity corresponding to the operating velocity command value $\dot{Y}$ instructed from the locus control lever 14. In addition, the first and second compensating velocity command values $\dot{X}_1$, $\dot{X}_2$ also assume predetermined values, and the second operating velocity command value $\dot{Y}_2$ is 0. Therefore, the angular velocity control values $\dot{T}_2$, $\dot{T}_3$ for the No. 2 and No. 3 arms 2, 3 output from the first circuit 360 for calculating the angular velocity control value serve to produce only the component of the compensating velocity for the tip of the No. 3 arm 3. In other words, the rotation of the No. 2 and No. 3 arms 2, 3 is controlled in such a manner as to compensate the deviation in the X-direction resulting from the rotation of the No. 1 arm 1 and the deviation in the X-direction representing an error between the targeted locus and the position of the tip of the No. 3 arm 3 in the X-direction. Consequently, the second locus contolling system is selected for effecting the locus control by controlling the velocity in the operating direction by means of the No. 1 arm 1 and the velocity in the compensating direction by means of the No. 2 and No. 3 ams 2, 3.

As described above, as k is made to change progressively at the time of changeover between the first locus controlling system and the second locus controlling system, a sudden change in the angular velocity of the arms is prevented and a shock caused by inertia is prevented.

(2) Changeover from the second locus controlling system to the first locus controlling system during lowering of the arm As the No. 1 arm 1 further rotates, when the angle of the No. 1 arm in which the No. 1 arm cylinder 4 is shrunk most, i.e., reaches the vicinity of $T_{1MIN}$, the output of the function generator 105 changes from 1 to 0. As a result, the output of the minimum value selection circuit 110 changes from 1 to 0, and $\dot{Y}_1$ becomes zero and $\dot{Y}_2$ becomes equivalent to Y again. Namely, the system is thus changed over to the first locus controlling system.

(3) Changeover from the first locus controlling system to the second locus controlling system during rising of the arm Under the condition where the angle $A_1$ of the No. 1 arm 1 is less than $A_{1MAX}$ and the operating height $H_Y$ is less than $H_{Y2}$ determined by the targeted operating radius $X_O$, if the operating velocity command value $\dot{Y}$ is made positive (i.e., for controlling the rising direction), the outputs 1 and 0 are respectively delivered from the function generator 104 and the function generator 107, and the output of the minimum value selection circuit 108 becomes zero. Since the contact a of the switching device 110 is closed during $\dot{Y}>0$, the first operating velocity command value $\dot{Y}_1$ is zero, and the second operating velocity command value $\dot{Y}_2$ is equivalent to $\dot{Y}$, resulting in selection of the first locus controlling system.

Subsequently, when the height of the tip, which is being raised in the Y-direction, of the No. 3 arm 3, i.e., the operating height $H_Y$ becomes $H_{Y2}$ or more, the output of the function generator 107 changes from 0 to 1. At this time, since the output of the function generator 104 remains unchanged, the output of the minimum value selection circuit 108 changes from 0 to 1. Accordingly, $\dot{Y}_1$ becomes equal to $\dot{Y}$, $\dot{Y}_2$ becomes zero, whereby the system is thus changed over to the second locus controlling system.

(4) Changeover from the second locus controlling system to the first locus controlling system during rising of the arm As the No. 1 arm 1 further rotates, when the angle $A_1$ of the No. 1 arm 1 becomes $A_{1MAX}$ or more, the output of the function generator 104 changes from 1 to 0. As a result, upon changing the output of the minimum value selection circuit 108 from 1 to 0, $\dot{Y}_1$ becomes zero and $\dot{Y}_2$ becomes equivalent to $\dot{Y}$ again, so that the system is thus changed over to the first locus controlling system.

As can be appreciated from the above, since the operating velocity command value is $\dot{Y}$ in both the first and second locus controlling systems, $(\dot{Y}_1+\dot{Y}_2)$ is equivalent to $\dot{Y}$ even when the system is changing gradually from the first to the second controlling system or vice versa.

The angular velocity control values $\dot{T}_1$, $\dot{T}_2$, $\dot{T}_3$ thus determined are subjected to link compensation by the flow-rate control value calculating circuit 430 so as to be converted into the flow-rate control values $Q_1$, $Q_2$, $Q_3$ for the first, second, and third cylinders 4, 5, 6. These flow-rate control values $Q_1$, $Q_2$ and $Q_3$ are supplied to the electric-hydraulic control valves 27, 16, 17, which, in turn, allows the pressure oil from the hydraulic source to be supplied to the first, second, and third cylinders 4, 5, 6 in predetermined directions and at predetermined flow rates.

Thus, when the first locus controlling system is selected, the No. 2 and No. 3 arms 2, 3 rotate so that the locus of the tip of the No. 3 arm 3 is depicted on the targeted locus. Meanwhile, when the second locus controlling system is selected, the No. 1 to 3 arms 1 to 3 rotate so that the locus of the tip of the No. 3 arm is depicted on the same.

[Fifth Embodiment]

In a fifth embodiment in accordance with the present invention, an arrangement is provided such that only the second locus controlling system in the fourth embodiment can be implemented. Hereafter, a description will be given by centering on points of difference.

Figure 31:
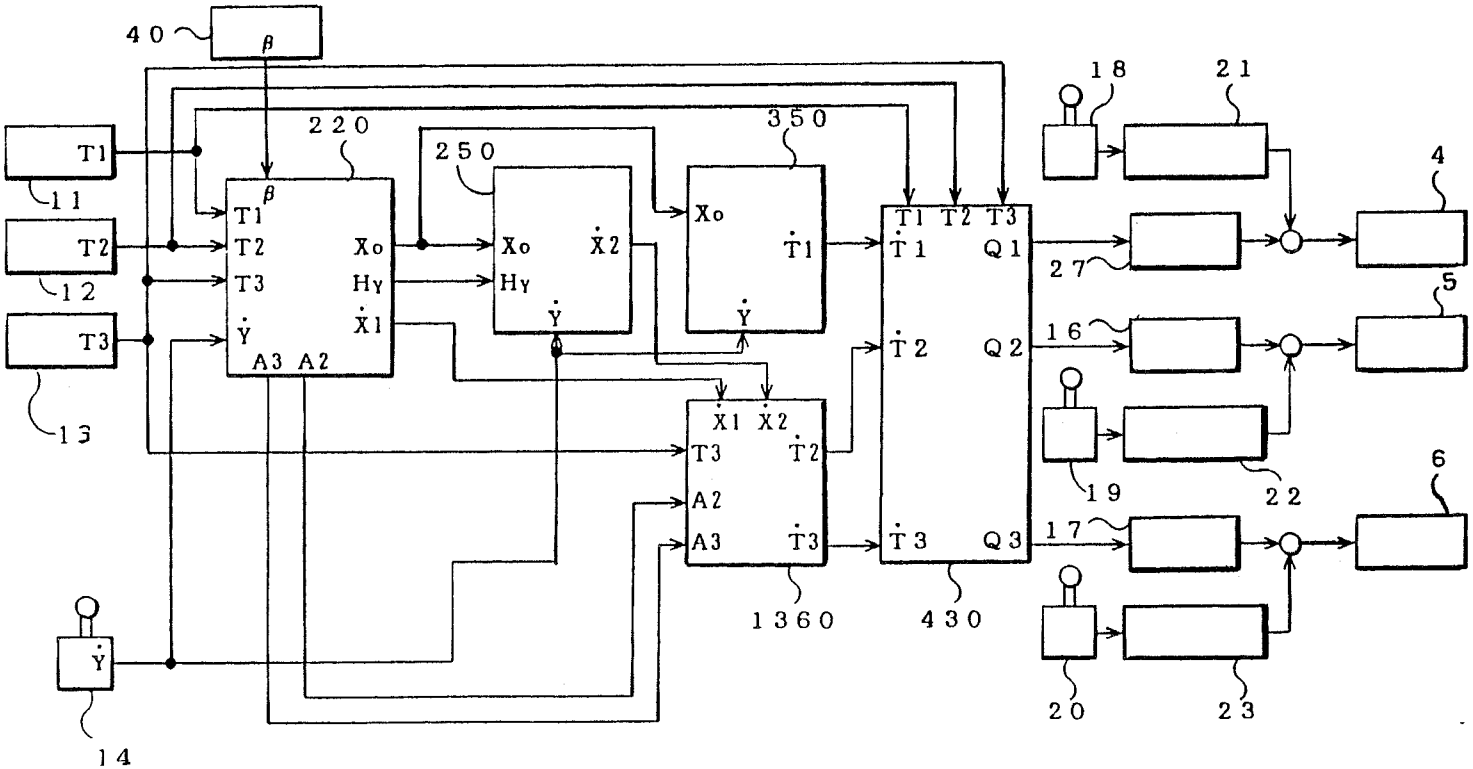
Figure 32:
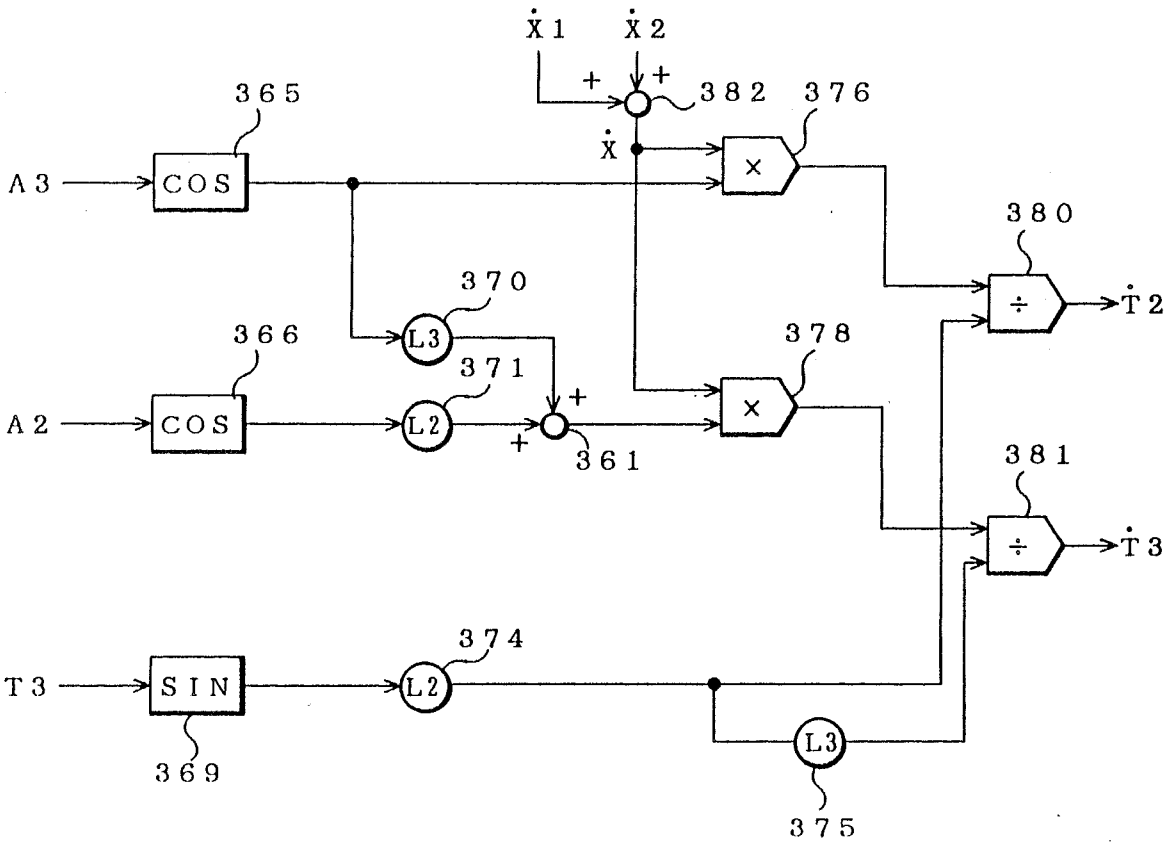

As shown in FIG. 31 which is a schematic diagram of the configuration of the overall apparatus, the arithmetic circuit 100 for dividing the operating velocity command value is omitted, and, consequently, a first angular velocity calculating circuit 1360 is simplified, as shown in FIG. 32. In other words, in this fifth embodiment, since the angular velocities $\dot{T}_2$, $\dot{T}_3$ of the second and third arms 2, 3, are determined by setting Y in Formulae (8) and (9) to zero, $\dot{T}_2$ and $\dot{T}_3$ can be expressed as $$\dot{T}_2 = \frac{\dot{X} \cdot \cos A_3}{L_2 \cdot \sin T_3} \tag{81}$$

$$\dot{T}_3 = \frac{\dot{X}\,(L_2 \cdot \cos A_2 + L_3 \cdot \cos A_3)}{L_2 \cdot L_3 \cdot \sin T_3} \tag{91}$$

Accordingly, the apparatus shown in FIG. 32 is arranged by omitting unnecessary portions from FIG. 29 so as to calculate Formulae (8′) and (9′). The other aspects of the arrangement are the same as those of the fourth embodiment, so that a description thereof will be omitted. In addition, the operation is substantially similar to that of the fourth embodiment except that the locus controlling system is selected in accordance with the posture of the three arms 1 to 3, so that a description thereof will be omitted.

With reference to FIG. 8, a description will be given of the advantage of the second locus controlling system.

In the first locus controlling system, if, for instance, the angle $\alpha$ of the No. 1 arm 1 with respect to the ground is fixed to $\alpha_1$ as in the case of FIG. 8, the tip of the No. 3 arm 3 can move vertically from the point C to the point D, but cannot move vertically continuously up to the point E by passing through the point D. Accordingly, if the No. 1 arm is operated manually while effecting the control of the locus from the point C to the point D by means of the control lever 14 in such a manner that the angle with respect to the ground changes from $\alpha_1$ to $\alpha_2$, the tip of the No. 3 arm 3 can be continuously moved vertically from the point C to the point E. However, the operator must operate the locus controlling lever 14 with one hand and operate the operating lever 18 for the No. 1 arm with the other hand. For this reason, the operation of opening and closing the bucket in a clamshell operation, for instance, must be performed by temporarily suspending the locus control. In other words, in this type of operation, the driving of each arm must be suspended temporarily, so that there has been the problem that the operating efficiency is deteriorated.

Therefore, according to the second locus controlling system, the locus control can be effected over a wide range of operation by simply operating the locus controlling lever 14 by one hand, and the operation of opening and closing the bucket, or the like can be effected with the other hand, thereby improving the operating efficiency because of a continuous operation.

In addition, if the No. 1 arm is manually driven by means of the operation lever 18 in the first locus controlling system, the operating velocity of the tip of the No. 3 arm resulting from the rotation of the No. 1 arm thus driven is added to the operating velocity of the tip of the No. 3 arm which has been established. Hence, this procedure is not suitable to an operation in which the velocity control of the arm movement is required as in the case of the earth auger.

In view of the requirment of the velocity control of the arm movement, the second locus controlling system can be suitably used, since the angular velocity of the No. 1 arm is controlled so that the operating velocity of the tip of the No. 3 arm is controlled can be suitably used.

Figure 33:
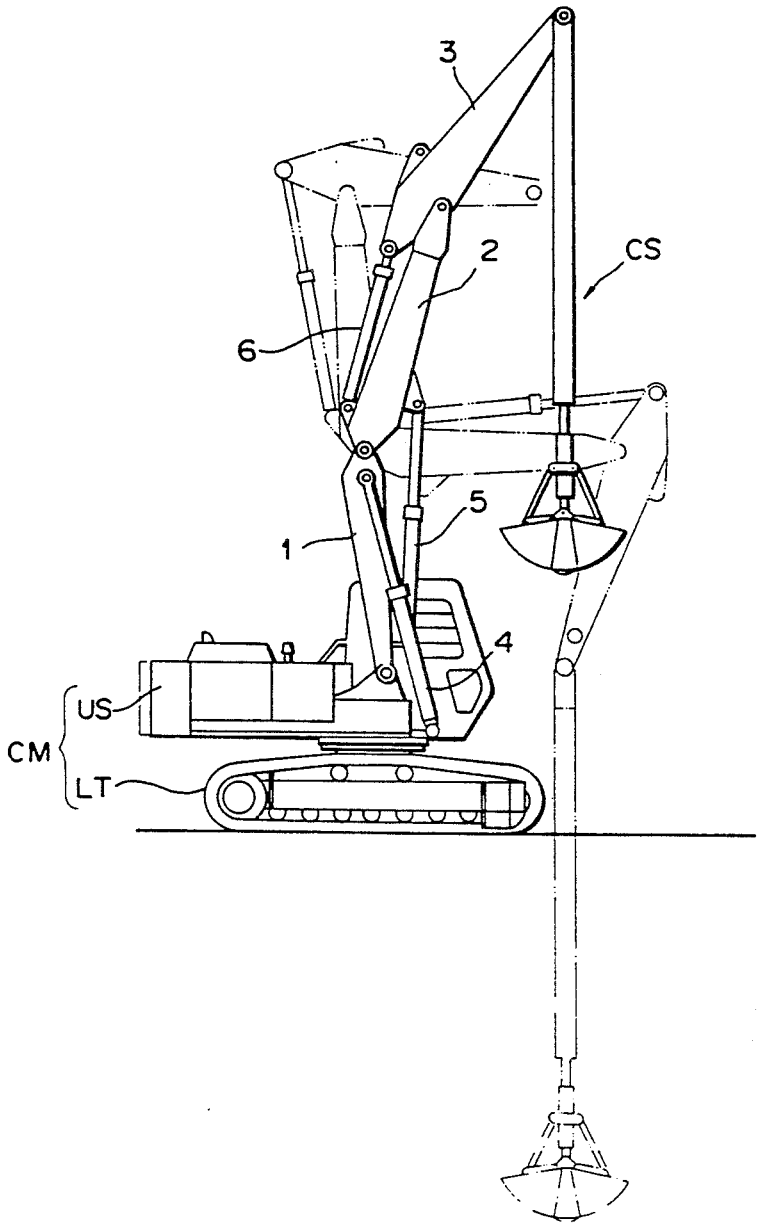
FIG. 33 is a side-elevational view of the industrial vehicle on which a clamshell unit is suitably mounted by using the fourth and fifth embodiments.

In the above-described fourth and fifth embodiments, it is possible to add the fourth arm 40 shown in FIGS. 10 and 11, in the same way as the first embodiment. In addition, hydraulic motors, hydraulic rotary actuators, or electric actuators may be used in place of the hydraulic cylinders so as to drive the No. 1 to No. 3 arms. Furthermore, a clamshell unit CS shown in FIG. 33 may be installed at the tip of the arm as an operating attachment. Moreover, instead of the arithmetic circuit 100 for dividing the operating velocity command value, an arrangement may be alternatively provided such that a manual switch is provided in order that the first and second locus controlling systems are selected by changing over the switch.

In cases where an operation in which the positional deviation mentioned above can be allowed to a certain degree as in the case of the clamshell operation is performed in the second locus controlling system, the No. 1 to No. 3 arms may be driven by the open-loop control alone, without performing the so-called positional feedback control in which the deviation of the actual position of the tip of the third arm from the targeted locus is fed back.

What is claimed is:

1. An apparatus for controlling the arm movement of an industrial vehicle having at least first and second arms whose movement is controlled so that a tip of said second arm moves along a targeted locus, first and second driving means for respectively rotatively moving said arms, and an operating attachment installed at the tip of said second arm, said apparatus comprising:

means for setting the direction of said targeted locus along which said tip of said second arm is moved;

arm angle detecting means for detecting angles related to said first and second arms;

position detecting means for detecting the position of said tip of said second arm;

commanding means for commanding an operating velocity of said tip of said second arm along said targeted locus;

deviation calculating means for calculating an amount of deviation of the position of the tip of said second arm in a direction perpendicular to a direction of said targeted locus from said targeted locus, on the basis of the detected position of said tip of said second arm;

means for calculating a command value for the compensating velocity in the direction perpendicular to said targeted locus on the basis of said amount of deviation and said command value for said operating velocity;

means for calculating the rotating velocity of said first and second arms in such a manner that said tip of said second arm moves at said commanded operating velocity along said targeted locus on the basis of said angles related to said first and second arms, said command value of said operating velocity, said command value for the compensating velocity, and said direction of said targeted locus; and means for controlling the driving of said first and second driving means to ensure that rotating velocities of said first and second arms become identical with the rotational velocities calculated by said rotating velocity calculating means, respectively.

2. An apparatus for controlling the arm movement of an industrial vehicle according to claim 1, wherein said targeted locus passes through the position of said tip of said second arm detected by said position detecting means at the start of control of a locus and extends in the direction set by said locus direction setting means.

3. An apparatus for controlling the arm movement of an industrial vehicle according to claim 1, wherein said means for calculating said command value for said compensating velocity calculates said command value for said compensating velocity on the basis of a product of said amount of deviation, an absolute value of said command value for said operating velocity, and a coefficient.

4. An apparatus for controlling the arm movement of an industrial vehicle according to claim 3, wherein, when an abosolute value of said deviation between the position of said tip of said second arm and said targeted locus is at a predetermined value or below, said amount of deviation is set to zero, and, when said absolute value of said deviation exceeds said predetermined value, said amount of deviation increases or decreases in proportion thereto.

5. An apparatus for controlling the arm movement of an industrial vehicle according to claim 4, wherein said predetermined value is made variable in correspondence with said absolute value of said command value for said operating velocity.

6. An apparatus for controlling the arm movement of an industrial vehicle according to claim 3, wherein, when said absolute value of said command value for said operating velocity is at said predetermined value or below, said coefficient is set to a constant, and, when said absolute value of said command value for said operating velocity exceeds said predetermined value, said coefficient decreases in proportion thereto.

7. An apparatus for controlling the arm movement of an industrial vehicle according to claim 1, wherein said means for setting said direction of said targeted locus is capable of manually setting said direction of said targeted locus arbitrarily.

8. An apparatus for controlling the arm movement of an industrial vehicle according to claim 1, wherein said means for setting said direction of said targeted locus includes operating attachment angle detecting means for detecting an angle of installation of said operating attachment and sets the direction of said targeted locus in the direction of said attachment installation angle on the basis of at least said angle of installation of said operating attachment detected.

9. An apparatus for controlling the arm movement of an industrial vehicle according to claim 8, wherein said means for setting said direction of said targeted locus consecutively sets the direction of said targeted locus in the direction of said angle of installation of said operating attachment, on the basis of said angle of installation of said operating attachment detected by said operating attachment angle detecting means.

10. An apparatus for controlling the arm movement of an industrial vehicle according to claim 8, further comprising:

means for driving said operating attachment operative to adjust said angle of installation of said operating attachment; and means for calculating the rotating velocity of said operating attachment in such a manner that a posture of said operating attachment remains constant even if said first and second arms rotate for the control of locus, wherein said drive controlling means controls the driving of said operating attachment driving means in such a manner that said operating attachment rotates at said calculated rotating velocity, in addition to controlling said first and second driving means, and said means for setting the direction of said targeted locus fixedly sets the direction of said targeted locus during an operation on the basis of said angle of installation of said operating attachment detected by said operating attachment angle detecting means at the start of the operation.

11. An apparatus for controlling the arm movement of an industrial vehicle having at least first, second, and third arms whose movement is controlled so that a tip of said third arm moves along a targeted locus, first, second, and third driving means for respectively rotatively moving said arms, and an operating attachment installed at the tip of said third arm, said apparatus comprising:

angle detecting means for detecting angles related to said first, second, and third arms;

position detecting means for detecting a position of said tip of said third arm;

means for commanding the operating velocity of said tip of said third arm along said targeted locus;

deviation calculating means for calculating an amount of deviation of the position of the tip of said third arm in a direction perpendicular to a direction of said targeted locus from said targeted locus, on the basis of the detected position of said tip of said third arm;

first means for calculating a command value for the compensating velocity for calcuating a first command value for the compensating velocity in a direction perpendicular to said targeted locus on the basis of said amount of deviation and said command value for said operating velocity;

second means for calculating a command value for the compensating velocity for calculating a second command value for the compensating velocity in the direction perpendicular to said targeted locus on the basis of said command value for said operating velocity and said position of said tip of said third arm;

first means for calculating the rotating velocity of said first arm on the basis of said command value for said operating velocity and said position of said tip of said third arm in such a manner that the moving velocity of said tip of said third arm in the direction of said targeted locus corresponds to said command value for said operating velocity;

second means for calculating the rotating velocity for calculating the rotating velocities of said second and third arms on the basis of said angles related to said second and third arms and said first and second command values for the compensating velocity in such a manner that the moving velocity of said tip of said third arm corresponds to a sum of said first and second command values for the compensating velocity; and means for controlling the driving of said first, second, and third driving means to ensure that the rotating velocities of said first, second, and third driving means become identical with that calculated by said first and second means for calculating the rotating velocity, respectively.

12. An apparatus for controlling the arm movement of an industrial vehicle according to claim 11, wherein said targeted locus extends in the direction of gravity which passes through the position of said tip of said third arm detected by said position detecting means at the start of controlling the arm movement.

13. An apparatus for controlling the arm movement of an industrial vehicle according to claim 11, wherein said first means for calculating said command value for said compensating velocity calculates said first command value for said compensating velocity on the basis of a product of said amount of deviation, an absolute value of said command value for said operating velocity, and a coefficient.

14. An apparatus for controlling the arm movement of an industrial vehicle according to claim 11, wherein said second means for calculating said command value for said compensating velocity calculates said second command value for said compensating velocity by dividing a product of said command value for said operating velocity and a position of the height of said tip of said third arm detected by said position detecting means, by a targeted operating radius of said tip of said third arm detected by said position detecting means.

15. An apparatus for controlling the arm movement of an industrial vehicle according to claim 13, wherein said second means for calculating said command value for said compensating velocity calculates said second command value for said compensating velocity by dividing a product of said command value for said operating velocity and a position of the height of said tip of said third arm detected by said position detecting means, by a targeted operating radius of said tip of said third arm detected by said position detecting means.

16. An apparatus for controlling the arm movement of an industrial vehicle according to claim 11, wherein said commanding means includes a single operating lever, and said first to third arms rotate in such a manner that said tip of said third arm moves along said targeted locus at said operating velocity corresponding to a rotating angle of said operating lever.

17. An apparatus for controlling the arm movement of an industrial vehicle having at least first, second, and third arms whose movement is controlled so that a tip of said third arm moves along a targeted locus, first, second, and third driving means for respectively rotatively moving said arms, and a operating attachment installed at the tip of said third arm, said apparatus comprising:

angle detecting means for detecting angles related to said first, second, and third arms;

position detecting means for detecting a position of said tip of said third arm;

means for commanding the operating velocity of said tip of said third arm along said targeted locus;

means for selecting either a first locus controlling system in which the position of the tip of said third arm is moved along said targeted locus by driving said second and third arms with said first arm fixed or a second locus controlling system in which the position of the tip of said third arm is moved along said targeted locus by driving said first to third arms;

deviation calculating means for calculating an amount of deviation of the position of the tip of said third arm in a direction perpendicular to a direction of said targeted locus from said targeted locus on the basis of the detected position of said tip of said third arm;

first means for calculating a command value for the compensating velocity for calculating a first command value for the compensating velocity in a direction perpendicular to said targeted locus on the basis of said amount of deviation and said command value for said operating velocity;

second means for calculating a command value for the compensating velocity for calculating a second command value for the compensating velocity in the direction perpendicular to said targeted locus on the basis of said command value for said operating velocity and said position of said tip of said third arm;

first means for calculating the rotating velocity which, when said first locus controlling system has been selected, sets the rotating velocity of said first arm to zero, and which, when said second locus controlling system has been selected, calculates the rotating velocity of said first arm on the basis of said command value for said operating velocity and said position of said tip of said third arm in such a manner that the moving velocity of said tip of said third arm in the direction of said targeted locus corresponds to said command value for said operating velocity;

second means for calculating the rotating velocity which, when said first controlling system has been selected, calculates the rotating velocities of said second and third arms on the basis of said angles related to said second and third arms, said command value for said operating velocity, and said first command value for said compensating velocity in such a manner that the moving velocity of said tip of said third arm corresponds to said first command value for said compensating velocity and said command value for said operating velocity, and which, when said second controlling system has been selected, calculates the rotating velocities of said second and third arms on the basis of said angles related to said second and third arms, said command value for said operating velocity, and said first and second command values for the compensating velocity in such a manner that the moving velocity of said tip of said third arm corresponds to a sum of said first and second command values for the compensating velocity and said command value for said operating velocity; and means for controlling the driving of said first, second, and third driving means to ensure that the rotating velocity of said first, second, and third driving means becomes identical with that calculated by said first and second means for calculating the rotating velocity.

18. An apparatus for controlling the arm movement of an industrial vehicle according to claim 17, wherein said targeted locus extends in the direction of gravity which passes through the position of said tip of said third arm detected by said position detecting means at the start of controlling the arm movement.

19. An apparatus for controlling the arm movement of an industrial vehicle according to claim 17, wherein said firs means for calculating said command value for said compensating velocity calculates said first command value for said compensating velocity on the basis of a product of said amount of deviation, an absolute value of said command value for said operating velocity and a coeffient.

20. An apparatus for controlling the arm movement of an industrial vehicle according to claim 17, wherein said second means for calculating said command value for said compensating velocity calculates said second command value for said compensating velocity by dividing a product of said command value for said operating velocity and a position of the height of said tip of said third arm detected by said position detecting means, by a targeted operating radius of said tip of said third arm detected by said position detecting means.

21. An apparatus for controlling the arm movement of an industrial vehicle according to claim 19, wherein said second means for calculating said command value for said compensating velocity calculates said second command value for said compensating velocity by dividing a product of said command value for said operating velocity and a position of the height of said tip of said third arm detected by said position detecting means, by a targeted operating radius of said tip of said third arm detected by said position detecting means.

22. An apparatus for controlling the arm movement of an industrial vehicle according to claim 17, wherein said commanding means includes a single operating lever, and said first to third arms rotate in such a manner that said tip of said third arm moves along said targeted locus at an operating velocity corresponding to a rotating angle of said operating lever.

* * * * *